US006265122B1

(12) United States Patent
Itami et al.

(10) Patent No.: US 6,265,122 B1
(45) Date of Patent: Jul. 24, 2001

(54) ELECTROPHOTOGRAPHIC PHOTORECEPTOR AND AN IMAGE FORMING APPARATUS AND A PROCESS CARTRIDGE USING THE SAME

(75) Inventors: Akihiko Itami; Tomoo Sakimura; Takeo Oshiba; Yohko Kitahara; Masahiko Kurachi; Kazuhisa Shida, all of Hachioji (JP)

(73) Assignee: Konica Corporation (JP)

( * ) Notice: Subject to any disclaimer, the term of this patent is extended or adjusted under 35 U.S.C. 154(b) by 0 days.

(21) Appl. No.: 09/506,512

(22) Filed: Feb. 17, 2000

(30) Foreign Application Priority Data

Feb. 22, 1999 (JP) ..... 11-043290
Feb. 22, 1999 (JP) ..... 11-043291

(51) Int. Cl.[7] ..... G03G 15/02
(52) U.S. Cl. ..... 430/58.2; 430/59.1; 430/59.4
(58) Field of Search ..... 430/58.2, 59.1, 430/59.4

(56) References Cited

U.S. PATENT DOCUMENTS 5,094,930 * 3/1992 Nomori et al. ..... 430/58.2
5,230,976 * 7/1993 Schank et al. ..... 430/58.2
5,547,790 * 8/1996 Umeda et al. ..... 430/58.2
5,681,679 * 10/1997 Schank et al. ..... 430/58.2
5,824,443 * 10/1998 Kushibiki et al. ..... 430/58.2
5,871,877 * 2/1999 Ong et al. ..... 430/59.4

* cited by examiner

*Primary Examiner*—Mark Chapman
(74) *Attorney, Agent, or Firm*—Jordan B. Bierman; Bierman, Muserlian and Lucas

(57) ABSTRACT

In an electrophotographic photoreceptor which comprises an electrically conductive support having thereon a multilayer composed of a photosensitive layer and a protective surface layer in said order, an electrophotographic photoreceptor characterized in that said protective surface layer comprised of a layer comprising structural units having charge transportability, as well as siloxane based resins having a cross linking structure, and said photosensitive layer comprises titanyl phthalocyanine having a maximum peak of Bragg angle (2θ±0.2)° at 27.2° with respect to Cu-Kα ray.

21 Claims, 1 Drawing Sheet

ELECTROPHOTOGRAPHIC PHOTORECEPTOR AND AN IMAGE FORMING APPARATUS AND A PROCESS CARTRIDGE USING THE SAME

FIELD OF THE INVENTION

The present invention relates to an electrophotographic photoreceptor, and an image forming apparatus as well as a process cartridge using the same.

BACKGROUND OF THE INVENTION

In recent years, in order to write data which are subjected to digital signal treatment, an electrophotographic image forming method has increasingly been employed in which an organic photoreceptor is subjected to dot light exposure to form an electrostatic latent image followed by forming an image employing reversal development.

It is required that a photoreceptor, which is employed in such a method, is stable over an extended period of time and also suitable for writing requiring high resolution. Generally, compared to inorganic photoreceptors, organic photoreceptors readily respond to various types of exposure light sources because the selection range of materials for said organic photoconductors is wider. In addition, the electric potential of organic photoconductors is more stable. Accordingly, techniques employing organic photoconductors have been inevitable, especially for a process which is required for high image quality. Specifically, as charge generating materials which are required to obtain an electrophotographic photoreceptor which exhibits high sensitivity in the long wavelength region which is capable of corresponding to semiconductor laser as well as LED which have been increasingly employed, and excellent durability, phthalocyanines as well as perylenes exhibit excellent properties.

On the other hand, the strength of organic photoconductors is low. Due to that, a photosensitive layer comprised of organic photoconductors is likely to suffer problems due to abrasion wear and scratches, and enhancement of the durability has been sought. As a method to overcome such a problem, considered is a combination of phthalocyanine or perylene, which exhibits high sensitivity in the long wavelength region, as well as excellent stability of electric potential with a surface layer which itself exhibits excellent strength.

However, when the aforementioned combination is applied to a photoreceptor comprised of phthalocyanine, a problem occurs in which interference fringes, due to laser beam exposure, tends to appear on the resultant images. It is thus necessary to solve this problem.

Further, a surface layer is required which can maintain the high sensitivity as well as electric potential properties of phthalocyanine as well as perylene. For instance, in these photosensitive layers, the efficiency of carrier generation for variation in the thickness of the photosensitive layer largely depends on the strength of the electric field and the layer abrasion wear results in large variation in sensitivity. Specifically, when the abrasion wear is extensive, charging properties as well as light decay properties are greatly affected. When the charge potential is lowered, background stain is formed, while when the light decay is not sufficient, problems, such as an decrease in density and the like, occur.

Consequently, a layer structure is required which exhibits high sensitivity, and further, can maintain and stabilize the resulting high sensitivity.

SUMMARY OF THE INVENTION

It is an object of the present invention to enhance surface strength properties, while maintaining high sensitivity. It is another object of the present invention to maintain excellent electric properties and specifically to enhance the stability of the electric potential. It is still another object of the present invention to provide a photoreceptor which exhibits minimum variation in the thickness of said photoreceptor during use over an extended period of time, and as a result, exhibits stable properties over an extended period of time. It is a further object of the present invention to minimize effects due to interference fringes due to laser beam exposure, while maintaining excellent electric properties.

The aforementioned objects are realized employing a electrophotographic photoreceptor described below, and an image forming apparatus and a process cartridge using the same. The present invention and its embodiments are described.

An electrophotographic photoreceptor comprising an electrically conductive support, a photosensitive layer containing titanyl phthalocyanine having crystal structure provided on the support and a protective surface layer provided on the photosensitive layer, wherein the protective surface layer contains structural units having charge transportability and a siloxane resin having a cross linking structure.

The titanyl phthalocyanine preferably has a maximum peak of Bragg angle ($2\theta \pm 0.2°$) at 27.20 with respect to Cu-K$\alpha$ ray.

The titanyl phthalocyanine preferably further has a maximum peak of Bragg angle ($2\theta \pm 0.2°$) at 9.6° with respect to Cu-K$\alpha$ ray.

The protective surface layer of said electrophotographic photoreceptor preferably is comprised of a siloxane resin having a cross linking structure obtained by allowing an organic silicon compound having a hydroxyl group or a hydrolyzable group to react with a compound comprising structural units having a hydroxyl group as well as charge transportability.

The protective surface layer preferably comprises an antioxidant.

The preferable example of the antioxidant is either hindered amine compound or hindered phenol compound.

An electrophotographic photoreceptor comprising an electrically conductive support, a photosensitive layer containing perylene compound provided on the support and a protective surface layer provided on the photosensitive layer, wherein the protective surface layer contains structural units having charge transportability and a siloxane resin having a cross linking structure. An electrophotographic photoreceptor comprising an electrically conductive support, a photosensitive layer containing titanyl phthalocyanine having crystal structure provided on the support and a protective surface layer provided on the photosensitive layer, wherein the protective surface layer contains structural units having charge transportability and a siloxane resin having a cross linking structure.

In the electrophotographic photoreceptor which comprises an electrically conductive support having thereon a multilayer composed of a photosensitive layer and a protective surface layer in said order, an electrophotographic photoreceptor characterized in that said protective surface layer comprised of a layer comprising structural units having charge transportability, as well as siloxane based resins having a cross linking structure, and said photosensitive layer comprises titanyl phthalocyanine having a maximum peak of Bragg angle ($2\theta \pm 0.2°$) at 27.2° with respect to Cu-K$\alpha$ ray.

The electrophotographic photoreceptor wherein said titanyl phthalocyanine has a maximum peak of Bragg angle (2θ±0.2°) at 27.2° with respect to Cu-Kα ray and a peak at 9.6°.

In an electrophotographic photoreceptor which comprises an electrically conductive support having thereon a multilayer composed of a photosensitive layer and a protective surface layer in said order, an electrophotographic photoreceptor characterized in that said protective surface layer comprises structural units having charge transportability, as well as siloxane based resins having a cross linking structure, and said photosensitive layer comprises titanyl phthalocyanine having a maximum peak of Bragg angle (2θ±0.2°) at 26.2° with respect to Cu-Kα ray.

In an electrophotographic photoreceptor which comprises an electrically conductive support having thereon a multilayer composed of a photosensitive layer and a protective surface layer in said order, an electrophotographic photoreceptor characterized in that said protective surface layer comprises structural units having charge transportability as well as siloxane based resins having a cross linking structure, and said photosensitive layer comprises titanyl phthalocyanine having a maximum peak of Bragg angle (2θ±0.2°) at 7.5° with respect to Cu-Kα ray.

In an electrophotographic photoreceptor which comprises an electrically conductive support having thereon a multilayer composed of a photosensitive layer and a protective surface layer in said order, an electrophotographic photoreceptor characterized in that said protective surface layer comprises structural units having charge transportability as well as siloxane based resins having a cross linking structure, and said photosensitive layer comprises titanyl phthalocyanine having a maximum peak of Bragg angle (2θ±0.2°) at 7.0° with respect to Cu-Kα ray.

An electrophotographic photoreceptor comprising an electrically conductive support, a photosensitive layer containing perylene compound provided on the support and a protective surface layer provided on the photosensitive layer, wherein the protective surface layer contains structural units having charge transportability and a siloxane resin having a cross linking structure.

The preferable example of the perylene compound is represented by the formula of (1), (2) or (3).

(1)

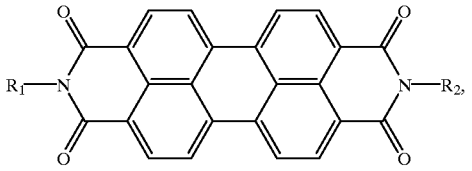

(2)

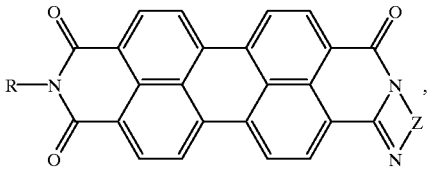

-continued (3)

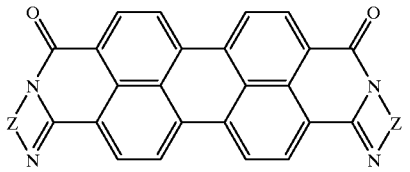

or

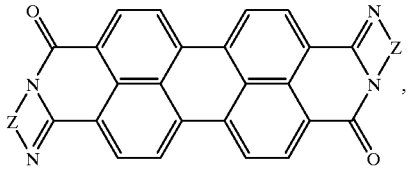

wherein $R_1$ and $R_2$ are the same or different, and each independently represents a hydrogen atom, alkyl, cycloalkyl, aryl, alkoxy, alkylamino, dialkylamino, benzyl, phenetyl, or heterocyclic group which may be substituted or unsubstituted, or 1,4-phenylene group, Z is atomic group necessary to form a substituted or unsubstituted heterocyclic group.

The electrophotographic photoreceptor wherein the protective surface layer of said electrophotographic photoreceptor is comprised of a siloxane resin having a cross linking structure obtained by allowing an organic silicon compound having a hydroxyl group or a hydrolyzable group to react with a compound comprising structural units having a hydroxyl group as well as charge transportability.

The electrophotographic photoreceptor wherein said protective surface layer comprises antioxidants.

The electrophotographic photoreceptor wherein said antioxidants are either hindered amine compounds or hindered phenol compounds.

An image forming apparatus employing the electrophotographic photoreceptor, wherein image formation is carried out through processes consisting of charging, image exposure, development, transfer, separation, and cleaning.

In a process cartridge employed for image formation through processes consisting of charging, image exposure, development, transfer, separating, and cleaning while employing a photoreceptor, a process cartridge characterized in being produced by combining the electrophotographic photoreceptor with at least one of a charging unit, an image exposing unit, a development unit, a transfer or separation unit and a cleaning unit.

DETAILED DESCRIPTION OF THE INVENTION

Figure 1:
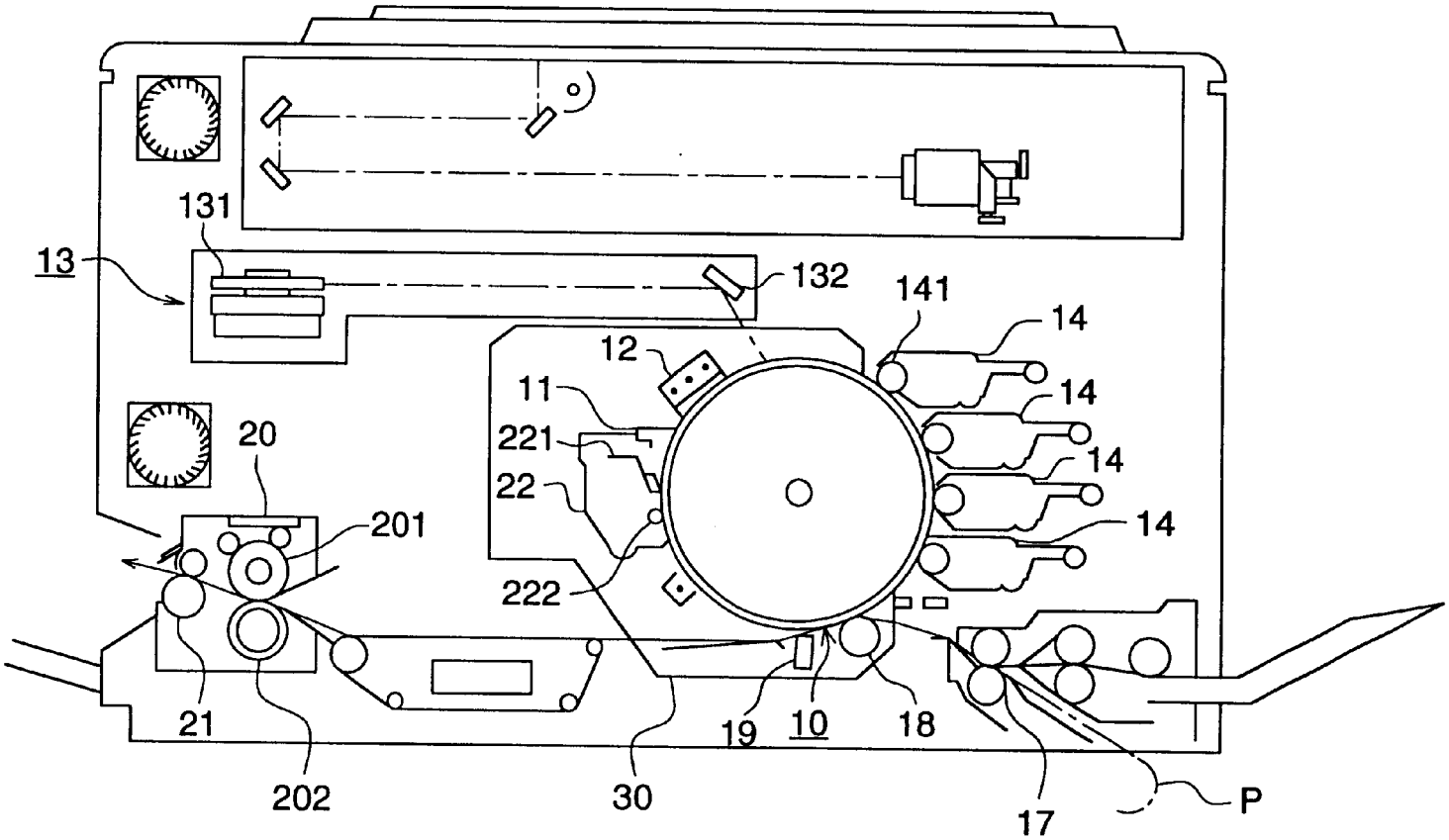
FIG. 1 is a cross-sectional view of the image forming apparatus according to the present invention.

The present inventors have investigated reasons of why a photoreceptor results in the effects of the present invention.

As a result, it is found that the protective surface layer of the present invention effectively minimizes interference fringes due to the difference in refractive indexes of the charge transport layer provided on the charge generating layer.

Accordingly, it is found that by combining the protective surface layer of the present invention with phthalocyanine, it is possible to obtain an electrophotographic photoreceptor which exhibits excellent strength properties as well as electric potential stability, and minimizes effects due to interference fringes by laser beam exposure.

The protective surface layer in the present invention is a layer comprising structural units having charge transportability as well as comprising siloxane based resins having a cross linking structure.

Siloxane resins having a cross linking structure include those in which a three-dimensional net structure is formed by utilizing new chemical bonds formed by adding in advance catalysts or cross linking agents to monomers, oligomers and polymers having siloxane bonds in the structural units, or the three-dimensional net structure is formed employing monomers, oligomers, and polymers through the siloxane bond. The structural units employed herein mean, for example, one which can form the three-dimensional net structure employing an alkoxysilane condensation reaction or a silanol condensation reaction. Further, particles such as colloidal silica may be incorporated into the three-dimensional net structure.

In the present invention, listed as hydrolyzable groups in the organic silicon compounds having a hydroxyl group or a hydrolyzable group, are a methoxy group, an ethoxy group, a methyl ethyl ketoxim group, a diethylamino group, an acetoxy group, a propenoxy group, a propoxy group, a butoxy group, a methoxyethoxy group, and the like. Of these, the hydrolyzable groups represented by -OR are preferred, wherein R represents a group of atoms which form an alkoxy group and the number of carbon atoms is preferably between 1 and 6. For example, listed are a methyl group, an ethyl group, a propyl group, a butyl group, a pentyl group, a hexyl group, a methoxyethyl group, and the like.

Generally regarding organic silicon compounds in the present invention, employed as raw materials for hardenable resins comprising a siloxane bond, when the number n of hydrolyzable groups directly bonding to the silicon atom is 1, polymerization reaction of organic silicon compounds is retarded. When n is 2, 3, or 4, a polymerization reaction tends to occur. Particularly, when n is 3 or 4, it is possible to proceed surely with the cross linking reaction. Accordingly, it is possible to control the storage stability of a coating composition, hardness of a coating layer, and the like which are obtained by controlling these.

Namely, the structural units having charge transportability are those having the structure which individually shows the properties having drift mobility of electrons or positive holes.

Listed as positive hole transport types are, for example, compounds having the following structural units and derivatives thereof, oxazole, oxadiazole, thiazole, triazole, imidazole, imidazolone, imidazoline, bisimidazolidine, styryl, hydrazone, benzidine, pyrazoline, stilbene, amine, oxazolone, benzothiazole, benzimidazole, quinazoline, benzofuran, acridine, phenazine, aminostilbene, poly-N-vinylcarbazole, poly-1-vinylpyrene, poly-9-vinylanthracene, and the like.

Further, listed as electron transport types are compounds having structural units such as succinic anhydride, maleic anhydride, phthalic anhydride, pyromellitic anhydride, mellitic anhydride, tetracyanoethylene, tetracyanoquinodimethane, nitrobenzene, dinitrobenzene, trinitrobenzene, tetranitrobenzene, nitrobenzonitrile, picryl chloride, quinonechlorimide, chloranil, bromanil, benzoquinone, naphthoquinone, diphenoquinone, tropoquinone, anthraquinone, 1-chloroantharaquinone, dinitroanthraquinone, 4-notrobenzophenone, 4.4'-dinitrobenzophenone, 4-nitrobenzalmalondinitrile, α-cyano-β-(p-cyanophenyl)-2-(p-chlorophenyl)ethylene, 2,7-dinitrofluorene, 2,4,7-trinitrofluorenone, 2,4,5,7-tetranitrofluorenone, 9-fluorenylidenedicyanomethylenemalononitrile, polynitro-9-fluoronylidenecuanomethylenemalonodinitrile, picric acid, o-nitrobenzoic acid, p-nitrobenzoic acid, 3,5-dinitrobenzoic acid, pentafluorobenzoic acid, 5-nitrosalicylic acid, 3,5-dinitrosalicylic acid, phthalic acid, mellitic acid and the like, and derivatives thereof. However, the present invention is not limited to these compounds.

As another definition of the charge transportable compound in the present invention, it may defined as a compound in which a detectable electric current due to charge transport is obtained employing common methods known in the art, such as a time-of-flight method and the like, which can detect charge transportability.

Representative compounds are charge transportable compounds represented by the general formula described below, which are capable of forming a resin layer upon combining with hardenable organic silicon compounds.

$$X—(R—OH)_m m \geqq 1$$

wherein X represents a structural unit having charge transportability, R represents a single bonding unit such as a substituted or unsubstituted alkylene or arylene group, and m is preferably an integer from 1 to 5.

Of these, listed as representatives are those shown below. For example, triarylamine based compounds as described herein are those which comprise a triarylamine structure as well as a hydroxyl group which bonds to a carbon atom via a carbon atom constituting said group.

1. Triarylamine Based Compounds

T-1

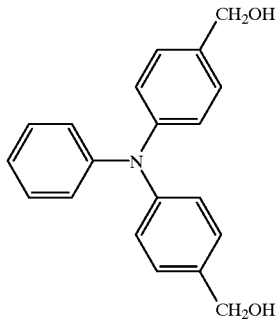

T-2

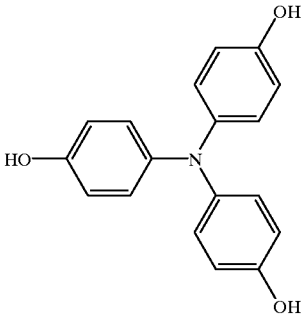

-continued
T-3
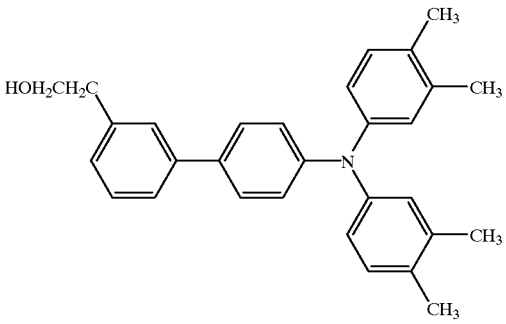
T-4
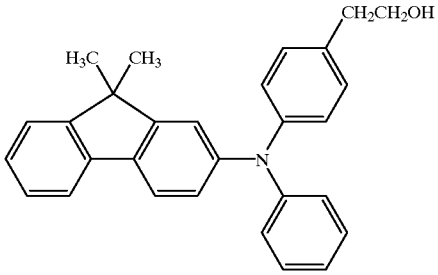
2. Hydrazine Based Compounds
H-1
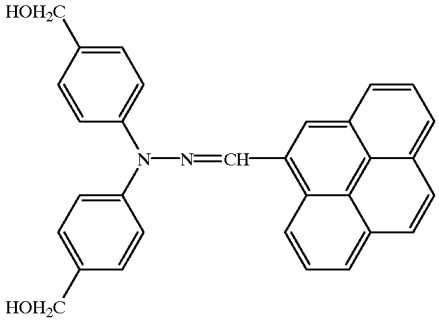
H-2
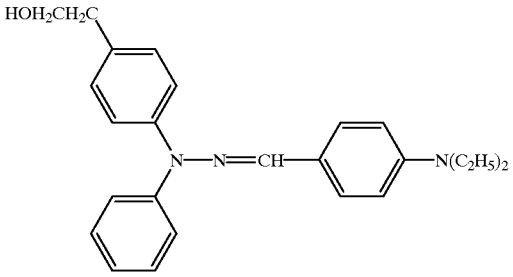
-continued
H-3
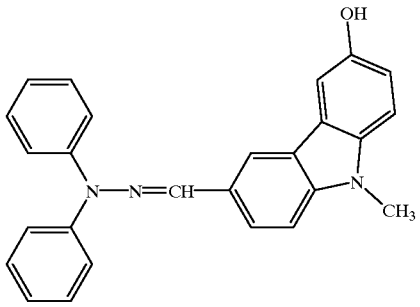
3. Stilbene Based Compounds
S-1
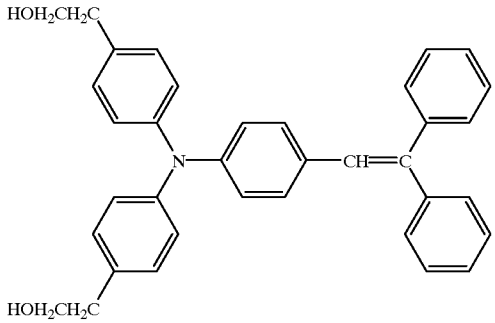
S-2
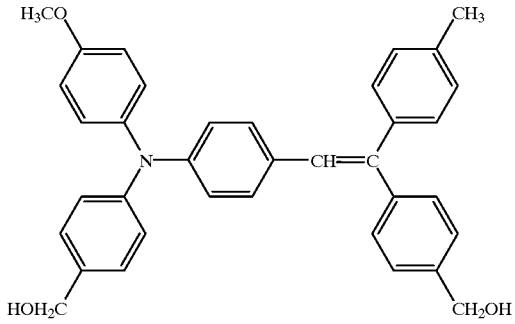
S-3
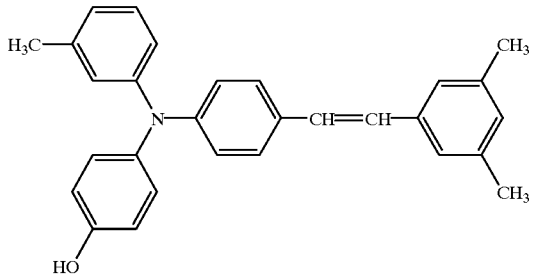

4. Benzidine Based Compounds

Be-1

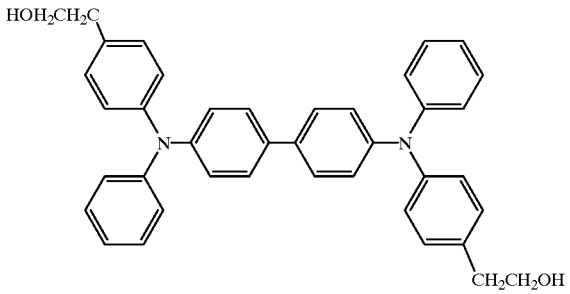

Be-2

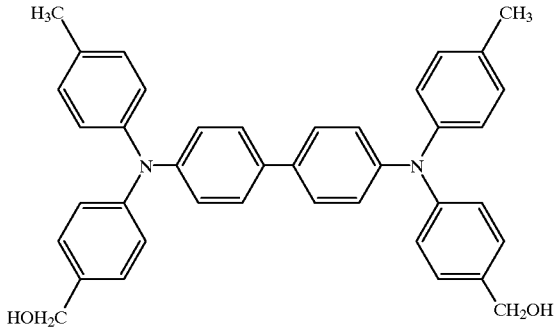

5. Butadiene Based Compounds

Bu-1

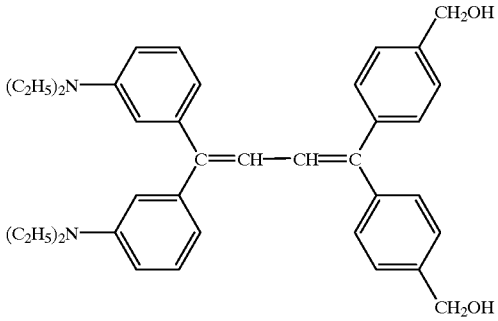

6. Other Compounds

So-1

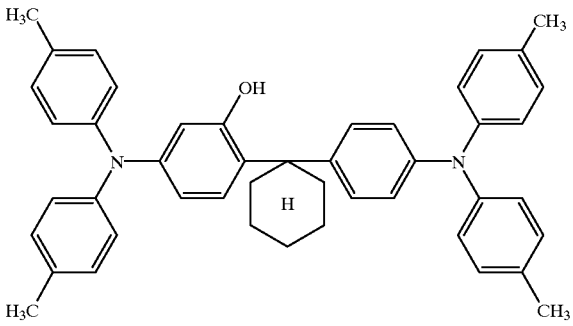

-continued

So-2

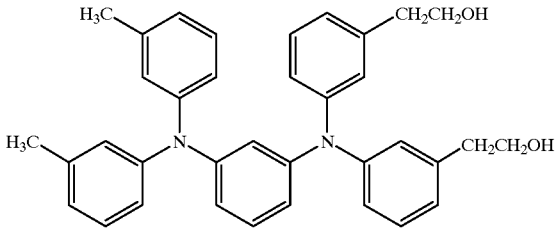

The photosensitive layer comprises any of phthalocyanine based compounds or perylene compounds.

The charge generating materials, which may be employed in the present invention, are titanyl phthalocyanines which are one type of phthalocyanine based compounds. Specifically, those having the following crystal structure are employed.

(1) Titanyl phthalocyanine, having a maximum peak at 27.2°

Its crystal form is called a Y type. It has a maximum peak at 27.2° of Bragg angle (2θ±0.2°) with respect to Cu-kα line in X-ray diffraction. Including the maximum peak as well as other peaks, generally it has peaks at 7.4°, 9.6°, 14.9°, 18.0°, 24.1°, and 27.2°, and of them, the main peaks are at 9.6° and 27.2°.

(2) Titanyl phthalocyanine, having a maximum peak at 26.2°

Its crystal form is called an A type. It has a maximum peak at 26.2° of Bragg angle (2θ±0.2°) with respect to Cu-kα line in X-ray diffraction. Including the maximum peak as well as other peaks, generally, it has peaks at 9.3°, 10.6°, 13.2°, 15.1°, 20.8°, and 26.2°, and of them, the main peaks are at 13.2° and 26.2°.

(3) Titanyl phthalocyanine, having a maximum peak at 7.5°

Its crystal form is called a B type. It has a maximum peak at 7.5° of Bragg angle (2θ±0.2°) with respect to Cu-kα line in X-ray diffraction. Including the maximum peak as well as other peaks, generally, it has peaks at 7.5°, 10.3°, 22.6°, 24.5°, 25.4°, and 28.6°, and of them, the main peaks are at 7.5° and 28.6°.

(4) Titanyl phthalocyanine, having a maximum peak at 7.0°

Its crystal form is called a C type. It has a maximum peak at 7.0° of Bragg angle (2θ±0.2°) with respect to Cu-kα line in X-ray diffraction. Including the maximum peak as well as other peaks, generally, it has peaks at 7.0°, 15.6°, 25.5°, and of them, the main peak is at 7.0°.

Listed as exemplified perylene compounds employed in the present invention may be 1-nitroprylene, 1,12-o-phenyleneperylene, 1,3,7,9-tetraacetoxyperylene, and the like. Of these, 3,4,9,10-tetracarboxylc acid imide derivatives are preferred, and those represented by general formulas (1), (2), and (3) are most suitably employed.

Those having either a symmetrical structure or a non-symmetrical structure may be employed. As is seen in general formula (3), those having either a cis form or a trans form are included. Each of these isomers may be individually employed through synthesis, or separation after said synthesis. Mixed isomers obtained by synthesis may be employed without any treatment.

Of these perylene compounds, those represented by general formula (3) are most suitably employed, and those represented by structural formulas described below are most preferred.

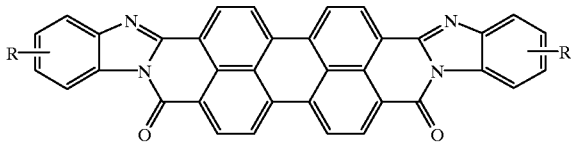

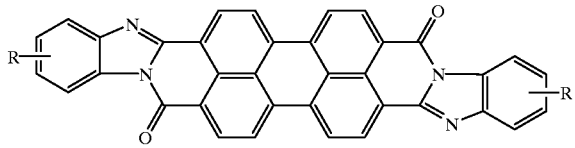

wherein R represents a hydrogen atom, a halogen atom, an alkyl group having from 1 to 10 carbon atoms, an aryl group, an alkoxy group and a heterocyclic group.

The aforementioned perylene compounds exhibit several polymorphic forms and any of crystal forms are suitably employed. For example, those are included which exhibit a crystal form which has peaks at 6.3°, 12.4°, 25.3°, and 27.1° of Bragg angle 2θ (±0.2°) of X-ray diffraction spectra and has its maximum peak at 12.4° or which exhibit an amorphous state having no clear peak. Further, when employed in the carrier generating layer, a perylene compound, which has a specified crystal form, may be dispersed and then employed, or its layer may be formed employing operations such as vaporization and the like. Still further, the vaporized layer may be subjected to crystal transition employing a solvent treatment and the like.

Next, specific examples of perylene compounds, which are preferably employed in the present invention, are shown below.

Compounds represented by general formula (1)

General Formula (1)

(1)

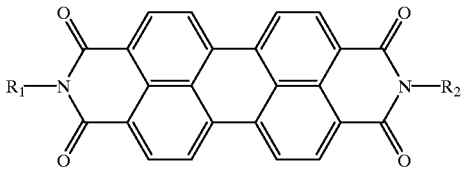

wherein $R_1$ and $R_2$ are the same or different, and each independently represents the groups shown below.

(1)-1

—H (1)-2

—$CH_3$ (1)-3

—$CH_2CH_3$ (1)-4

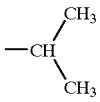

(1)-5

—$(CH_2)_2CH_3$ (1)-6

—$(CH_2)_3CH_3$

-continued (1)-7

—$(CH_2)_4CH_3$ (1)-8

—$(CH_2)_5CH_3$ (1)-9

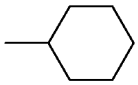

(1)-10

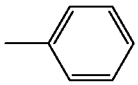

(1)-11

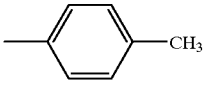

(1)-12

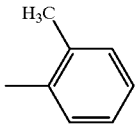

(1)-13

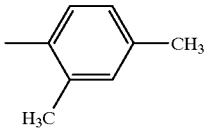

(1)-14

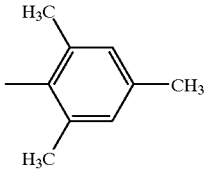

(1)-15

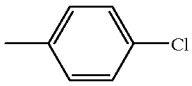

(1)-16

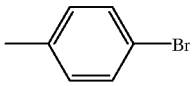

(1)-17

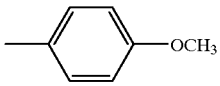

(1)-18

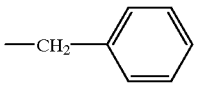

(1)-19

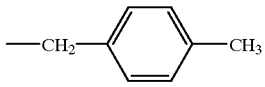

-continued
(1)-20
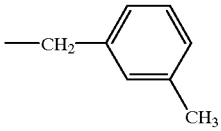
(1)-21
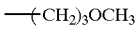
(1)-22
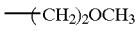
(1)-23
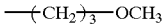
(1)-24
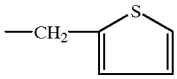
(1)-25
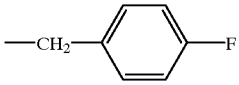
(1)-26
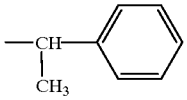
(1)-27
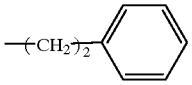
(1)-28
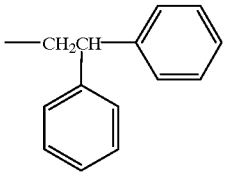
(1)-29
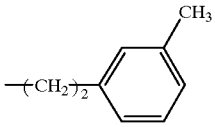
(1)-30
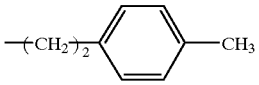
(1)-31
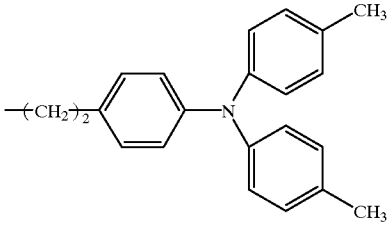
(1)-32
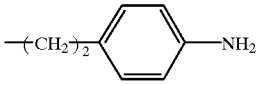
-continued
(1)-33
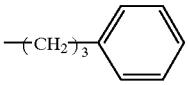
(1)-34
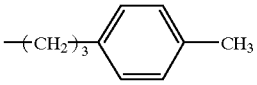
(1)-35
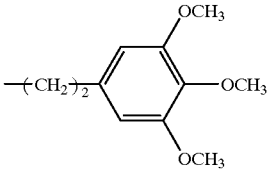
(1)-36
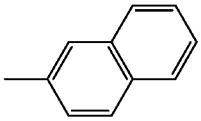
(1)-37
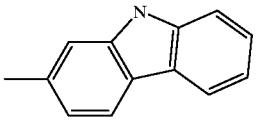
Compounds represented by general formula (2)
General Formula (2)
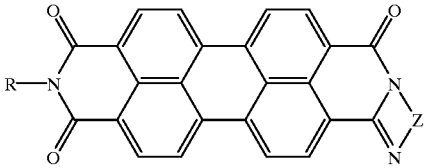
(1)
wherein $R_1$ is the same as that in the general formula (1), and Z represents the groups shown below.
(2)-1
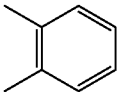
(2)-2
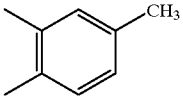
(2)-3
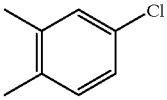

-continued
(2)-4
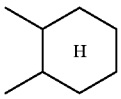
(2)-5
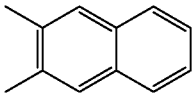
(2)-6
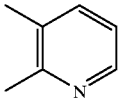
(2)-7
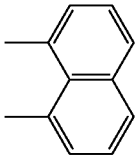
(2)-8
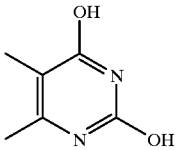
(2)-9
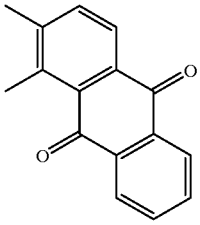
In the case of a dimer, Z represents the group shown below.
(2)-10
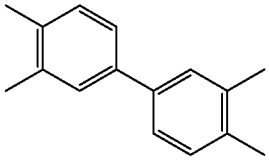
(2)-11
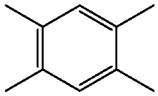
Compounds represented by general formula (3)
(3)-1
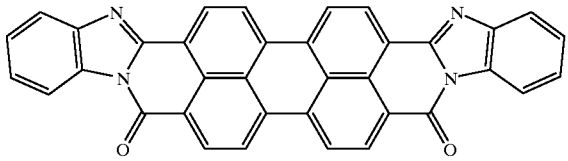
(3)-2
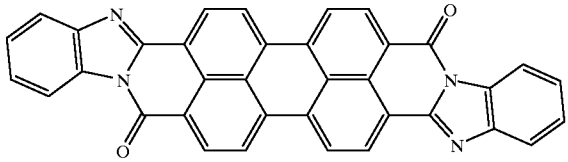
(3)-3
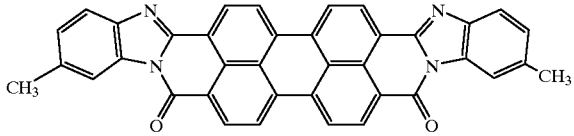
(3)-4
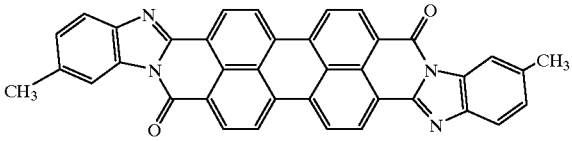
(3)-5
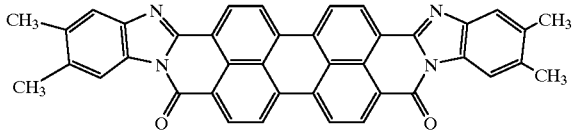
(3)-6
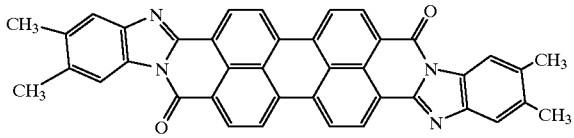
(3)-7
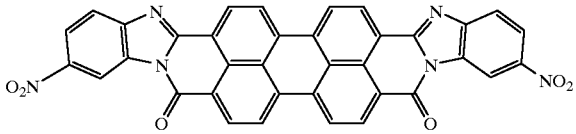
(3)-8
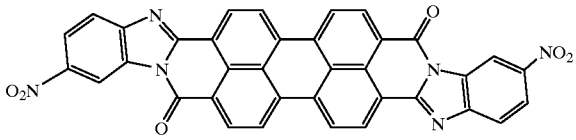

-continued
(3)-9
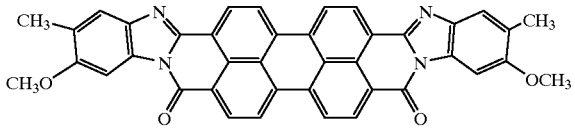
(3)-10
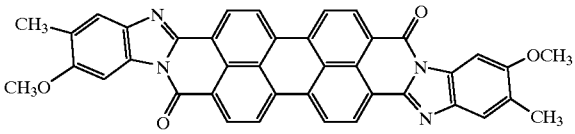
(3)-11
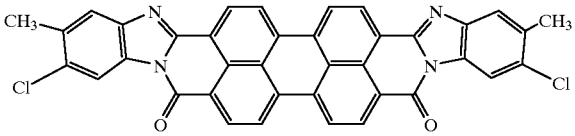
(3)-12
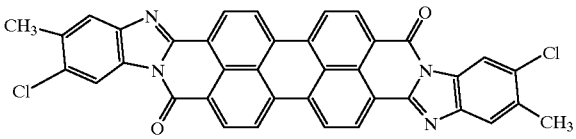
(3)-13
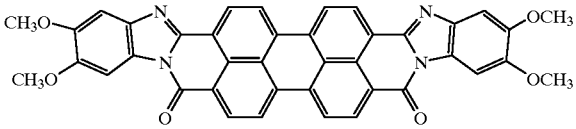
(3)-14
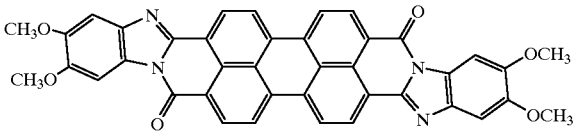
(3)-15
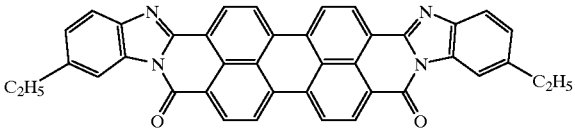
(3)-16
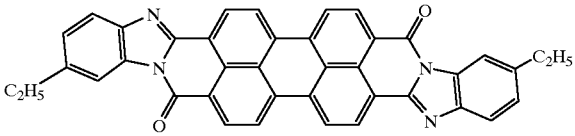
(3)-17
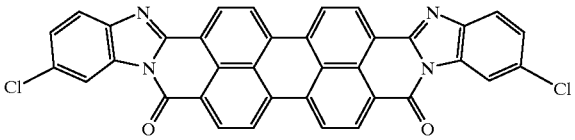
-continued
(3)-18
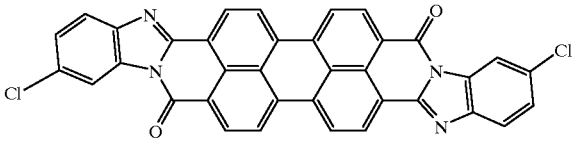
(3)-19
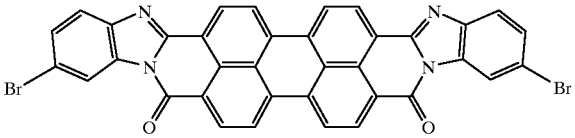
(3)-20
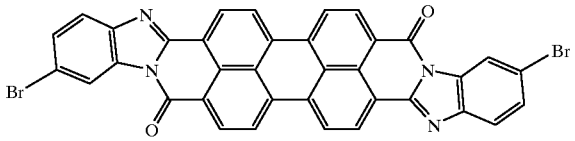
(3)-21
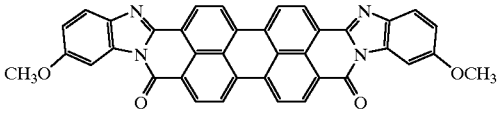
(3)-22
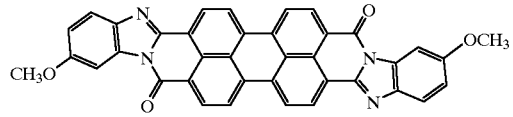
(3)-23
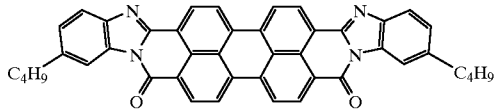
(3)-24
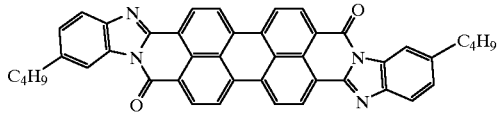
(3)-25
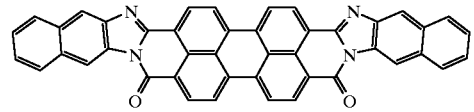
(3)-26
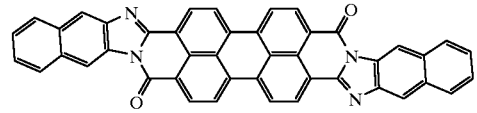
(3)-27
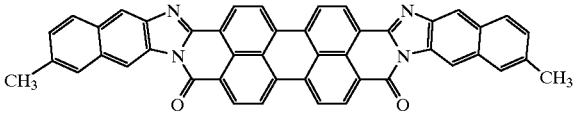
(3)-28
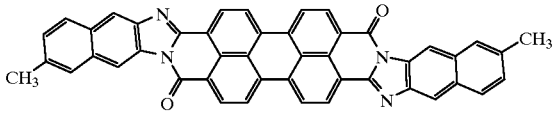
A layer is formed employing only a perylene compound which is employed as a charge generating material (CGM)

incorporated into the photosensitive layer of the present invention or said perylene compound together with suitable binders.

Further, in the present invention, antioxidants, especially those, having a hindered phenol structural unit and/or a hindered amine structural unit, are preferably added to said protective surface layer. Though the function has not yet been clarified, it is discovered that by so doing, the effects of the present invention are further enhanced.

The representative compounds are shown below.

1-1

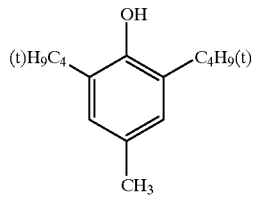

1-2

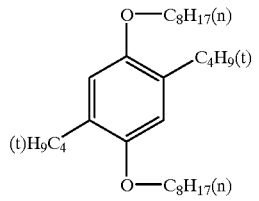

1-3

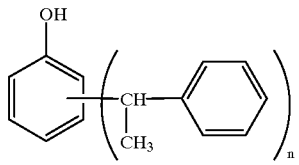

1-4

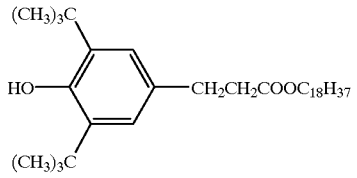

1-5

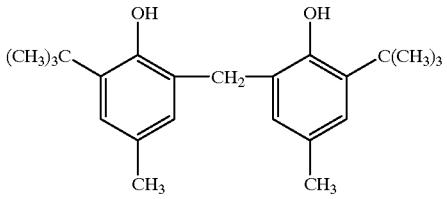

1-6

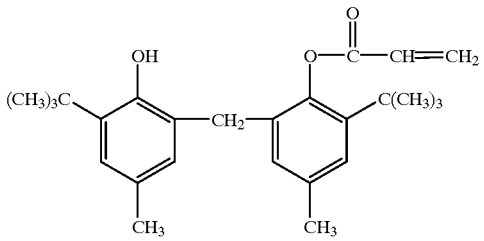

1-7

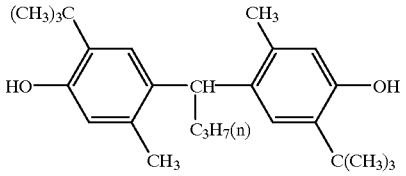

-continued
1-8
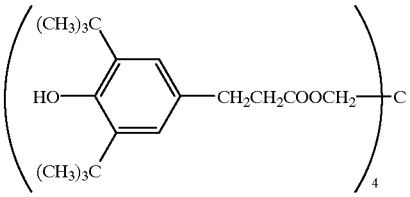
1-9
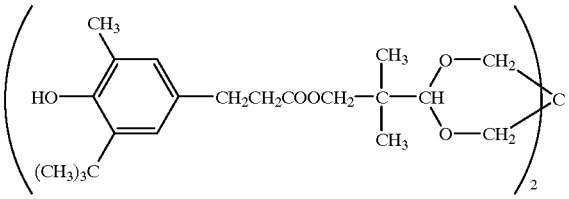
1-10
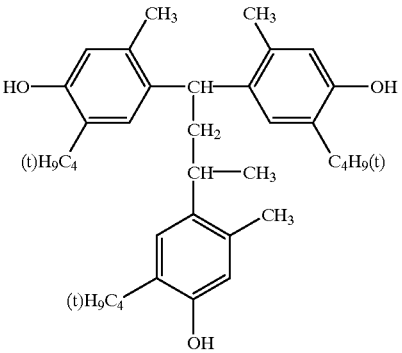
1-11
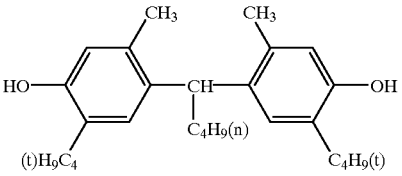
1-12
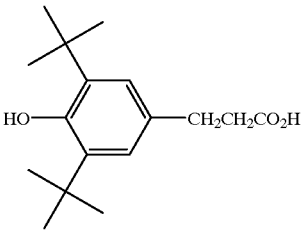

-continued
1-13
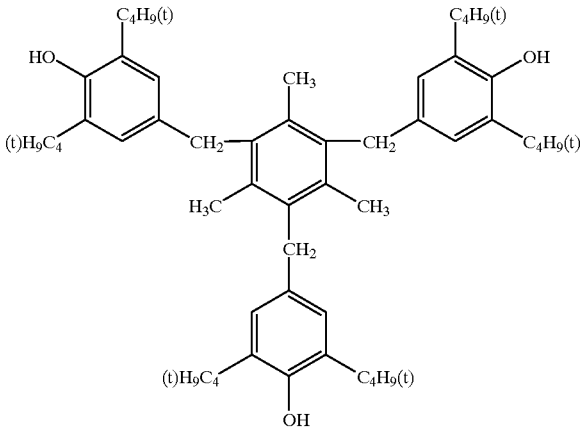
1-14
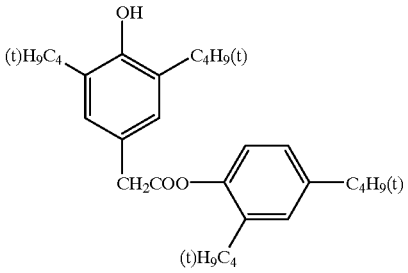
1-15
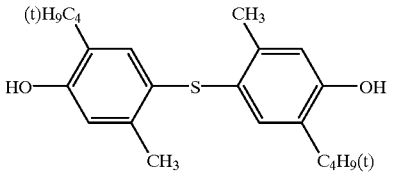
1-16
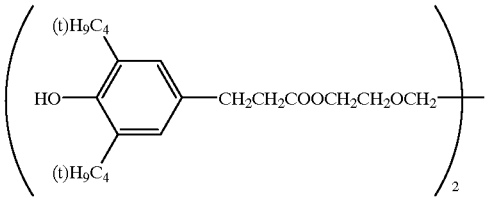
1-17
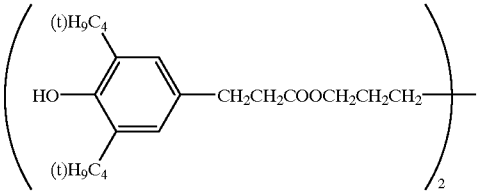
1-18
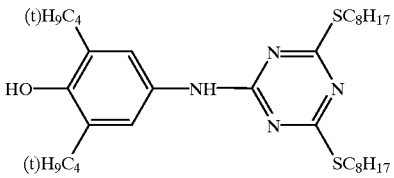

-continued
1-19
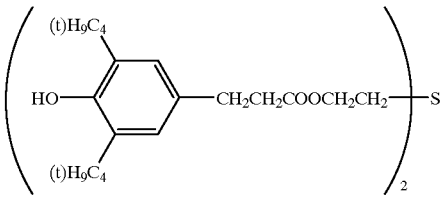
1-20
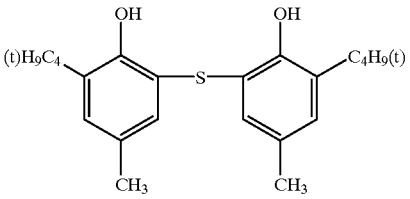
1-21
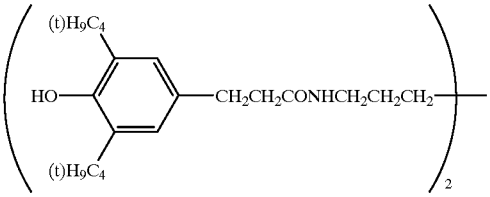
1-22
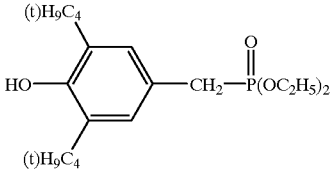
1-23
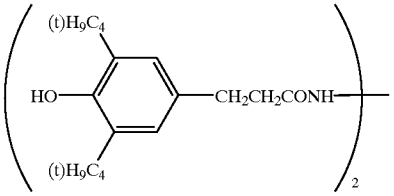
1-24
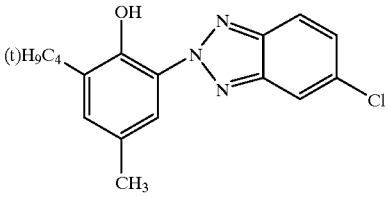
1-25
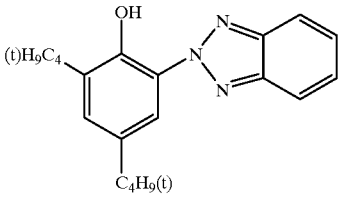

-continued
1-26
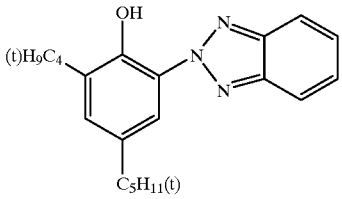
1-27
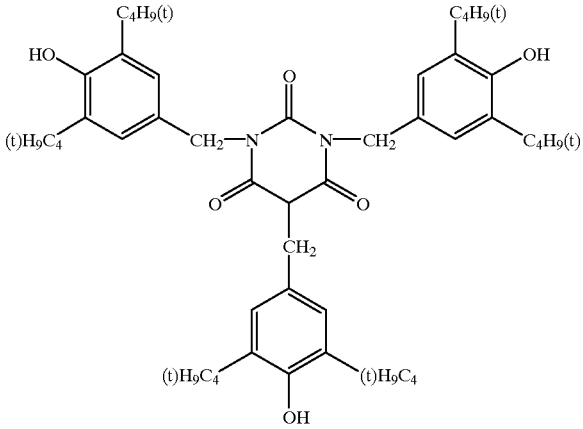
1-28
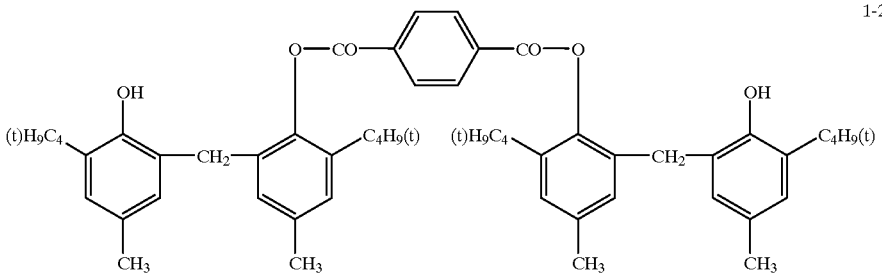
1-29
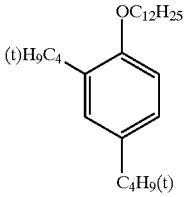
1-30
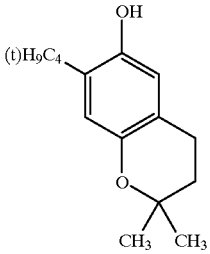

-continued
1-31
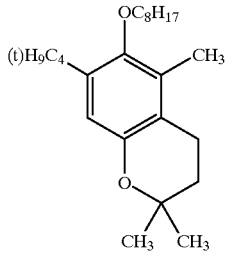
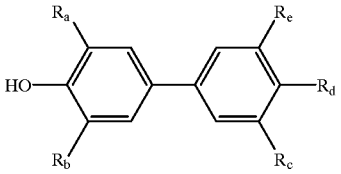
| | $R_a$ | $R_b$ | $R_c$ | $R_d$ | $R_e$ |
|---|---|---|---|---|---|
| 1-32 | Bu(t) | Bu(t) | H | H | H |
| 1-33 | Bu(t) | Bu(t) | H | $CH_3$ | H |
| 1-34 | Bu(t) | Bu(t) | Bu(t) | H | Bu(t) |
| 1-35 | Bu(t) | Bu(t) | Bu(t) | OH | Bu(t) |
| 1-36 | Bu(t) | H | H | H | H |
| 1-37 | $C_5H_{11}$(t) | $C_5H_{11}$(t) | H | H | H |
| 1-38 | $C_5H_{11}$(t) | H | H | H | H |
| 1-39 | Bu(t) | $CH_3$ | H | H | H |
1-40
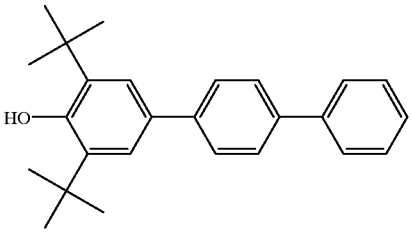
1-41
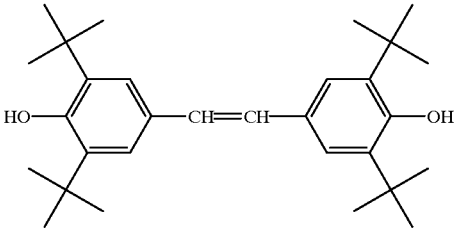
1-42
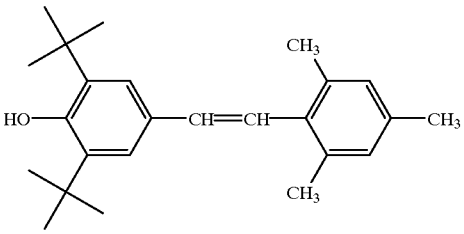

-continued
1-43
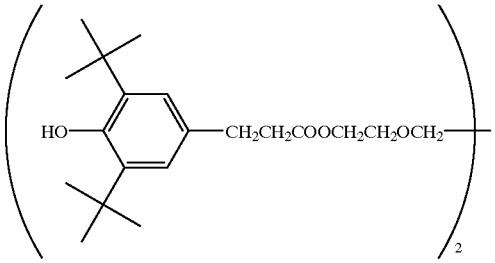
1-44
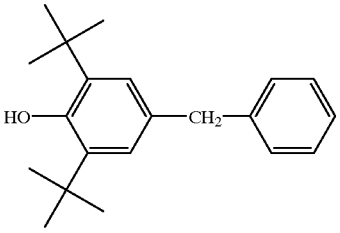
1-45
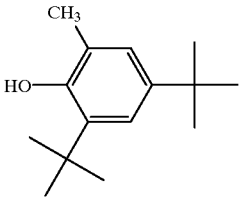
1-46
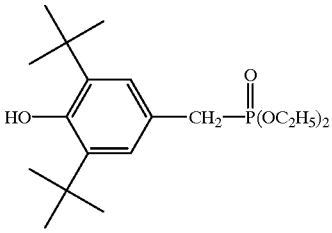
1-47
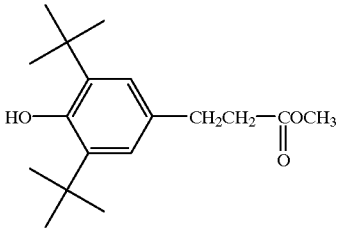
1-48
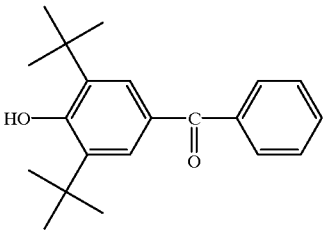

-continued
1-49
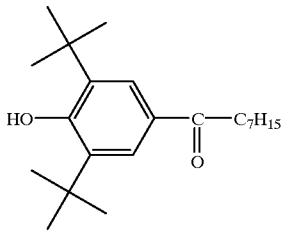
1-50
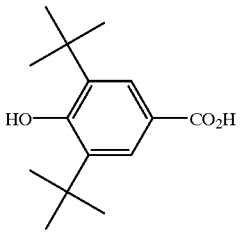
1-51
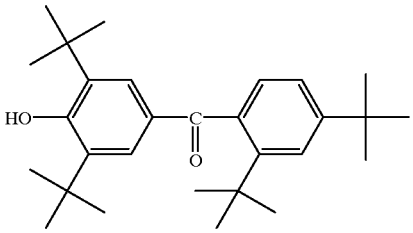
1-52
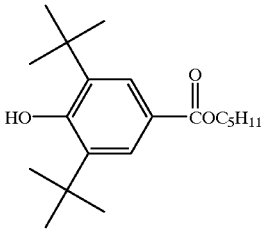
1-53
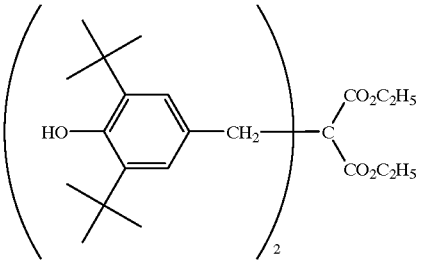
1-54
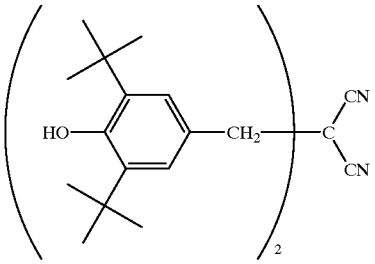

-continued
1-55
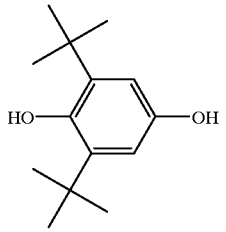
1-56
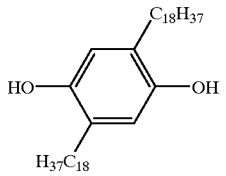
1-57
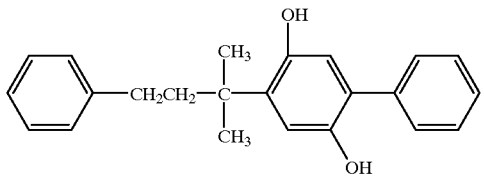
1-58
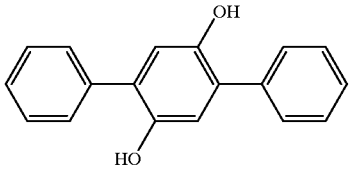
1-59
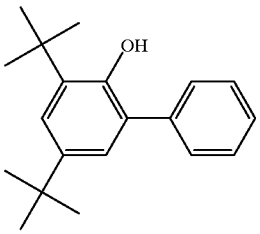
1-60
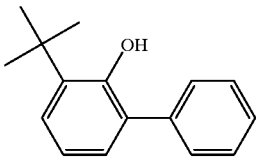
1-61
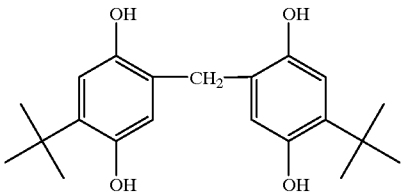

-continued
1-62
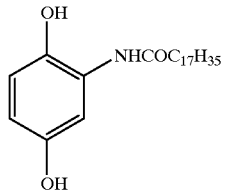
1-63
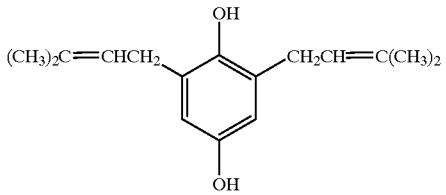
2-1
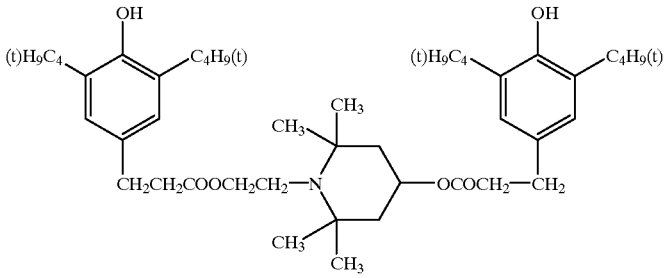
2-2
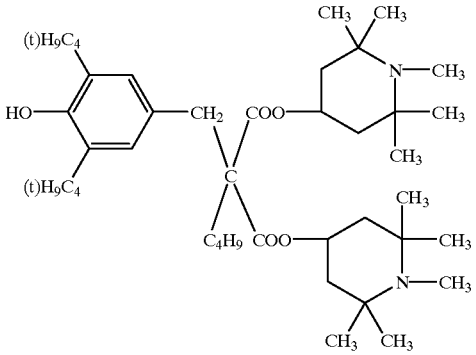
2-3
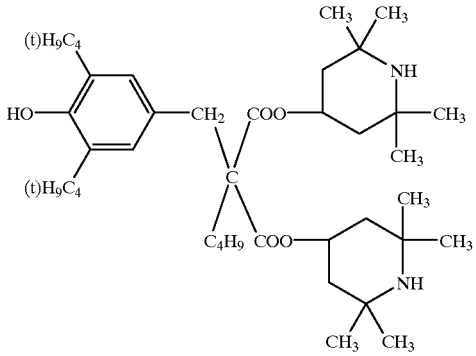

-continued
2-4
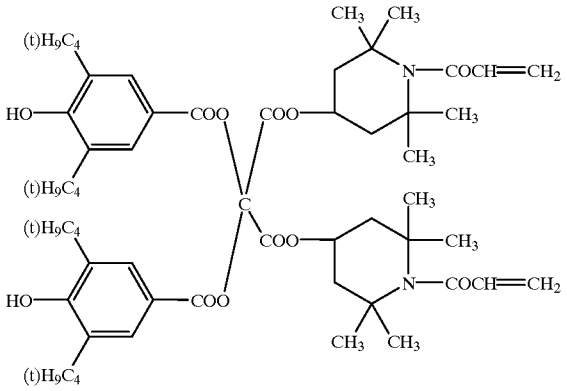
2-5
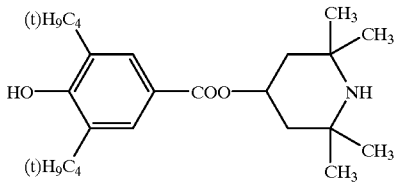
2-6
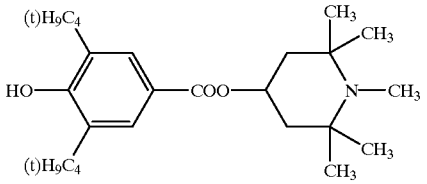
2-7
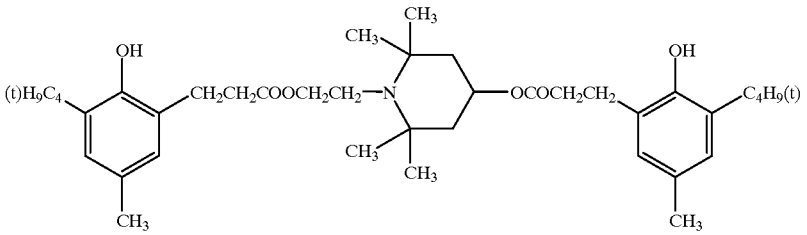
2-8
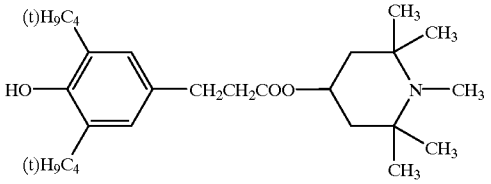
2-9
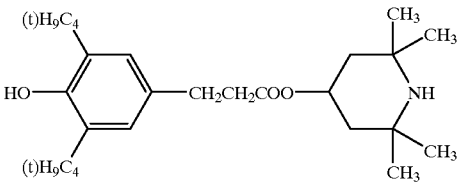

-continued
2-10
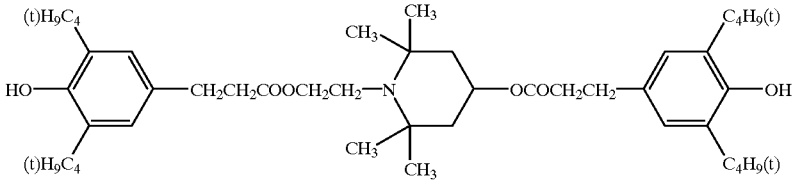
3-1
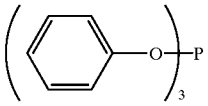
3-2
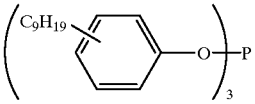
$(C_2H_5O)_3P$ 3-3
$(C_8H_{17})_3P$ 3-4
$(C_{10}H_{21}O)_3P$ 3-5
$(C_{13}H_{27}O)_3)P$ 3-6
3-7
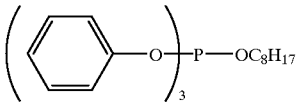
3-8
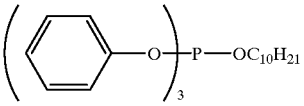
3-9
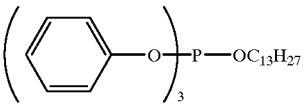
3-10
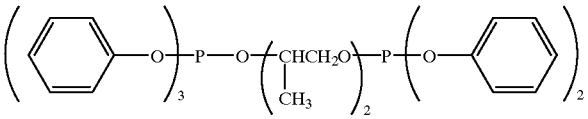
3-11
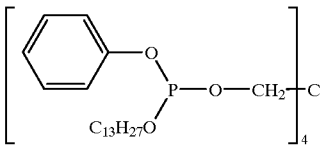
3-12
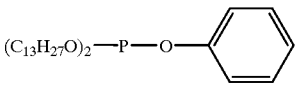
3-13
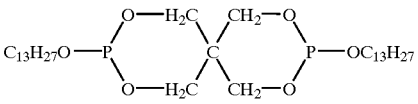
3-14
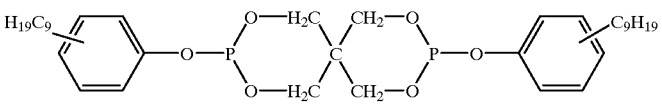

-continued

| | |
|---|---|
| $(C_{18}H_{35}O)_3P$ | 3-15 |
| 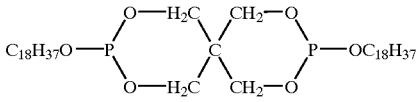 | 3-16 |
| 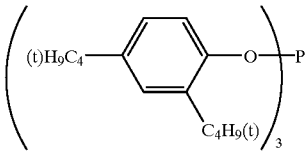 | 3-17 |
| 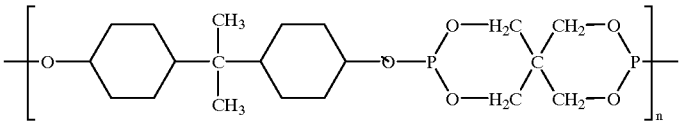 | 3-18 |
| $(C_8H_{17}OCOCH_2CH_2)_2S$ | 4-1 |
| $(C_{10}H_{21}OCOCH_2CH_2)_2S$ | 4-2 |
| $(C_{12}H_{25}OCOCH_2CH_2)_2S$ | 4-3 |
| $(C_{14}H_{29}OCOCH_2CH_2)_2S$ | 4-4 |
| $(C_{18}H_{37}OCOCH_2CH_2)_2S$ | 4-5 |
| 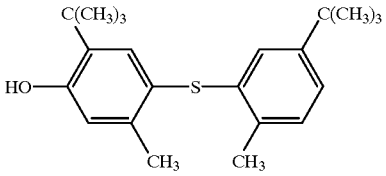 | 4-6 |

The photosensitive layer is formed with an adequate binder resin and the phthalocyanine pigment singly or in combination with the perylene compound as the charge generating material.

As for the layer structure of the electrophotographic photoreceptor, the preferred structure is such that the resin layer is applied onto a photosensitive layer composed of a charge generating layer, a charge transport layer.

Charge transport materials (CTM) incorporated into the above-mentioned photosensitive layer include, for example, oxazole derivatives, oxadiazole derivatives, thiazole derivatives, thiadiazole derivatives, triazole derivatives, imidazole derivatives, imidazolone derivatives, imidazoline derivatives, bisimidazolidine derivatives, styryl compounds, hydrazone compounds, benzidine compounds, pyrazoline derivatives, stilbene compounds, amine derivatives, oxazolone derivatives, benzothiazole derivatives, benzimidazole derivatives derivative, quinazoline derivatives, benzofuran derivatives, acridine derivatives, phenazine derivatives, aminostilbene derivatives, poly-N-vinylcarbazole, poly-1-vinylpyrene, poly-9-vinylanthracene, and the like.

Binder resins, which are incorporated into a single-layered photosensitive layer, a charge generating layer (CGL) and a charge transport layer (CTL), include polycarbonate resins, polyester resins, polystyrene resins, methacrylic resins, acrylic resins, polyvinyl chloride resins, polyvinylidene chloride resins, polyvinyl butyral resins, polyvinyl acetate resins, styrene-butadiene resins, vinylidene chloride-acrylonitrile copolymer resins, vinyl chloride-maleic anhydride copolymer resins, urethane resins, silicon resins, epoxy resins, silicon-alkyd resins, phenol resins, polysilicone resins, polyvinyl carbazole, and the like.

In the present invention, the ratio of the charge generating material in the charge generating layer to the binder resin is preferably between 1:5 and 5:1 in terms of weight ratio. Further, the thickness of the charge generating layer is preferably no more than 5 $\mu$m, and is more preferably between 0.05 and 2 $\mu$m.

Furthermore, the charge generating layer is formed by coating a composition prepared by dissolving the above-mentioned charge generating material along with the binder resin in a suitable solvent and subsequently dried. The mixing ratio of the charge transport materials to the binder resin is preferably between 3:1 and 1:3 in terms of weight ratio.

The thickness of the charge transport layer is preferably between 5 and 50 $\mu$m, and is more preferably between 10 and 40 $\mu$m. Furthermore, when a plurality of charge transport layers are provided, the thickness of the upper charge transport layer is preferably no more than 10 $\mu$m, and is preferably less than the total layer thickness of the charge transport layer provided under the upper layer of the charge transport layer.

The resin layer comprising the above-mentioned hardenable siloxane based resin may be employed as the above-mentioned charge transport layer. However, said layer is preferably provided as another layer on a photosensitive layer such as a charge transport layer and a charge generating layer, or a single-type charge generating-transport layer. In such a case, an adhesive layer is preferably provided between the above-mentioned photosensitive layer and the resin layer of the present invention.

Listed as solvents or dispersion media employed to produce the photoreceptor of the present invention are n-butylamine, diethylamine, ethylenediamine, isopropanolamine, triethanolamine, triethylenediamine, N,N-dimethylformamide, acetone, methyl ethyl ketone, methyl isopropyl ketone, cyclohexanone, benzene, toluene, xylene, chloroform, dichloromethane, 1,2-dichloroethane, 1,2-dichloropropane 1,1,2-trichloroethane, 1,1,1-trichloroethane, trichloroethylene, tetrachloroethane, tetrahydrofuran, dioxolane, dioxane, methanol, ethanol, butanol, isopropanol, ethyl acetate, butyl acetate, dimethylsulfoxide, methyl cellosolve, and the like. Of these, most preferably employed are dichloromethane, 1,2-dichloroethane or methyl ethyl ketone. Furthermore, these solvents may be employed individually or in combination of two types or more.

Next, electrically conductive supports for use in the electrophotographic photoreceptor of the present invention include:

1) metal plates such as aluminum, stainless steel, and the like
2) those prepared by laminating or evaporating a thin metal layer such as aluminum, palladium, gold, and the like onto a support such as paper, plastic film, and the like
3) those prepared by coating or evaporating a layer composed of electrically conductive compounds such as an electrically conductive polymer, indium oxide, tin oxide, and the like.

Next, employed as coating methods to produce the electrophotographic photoreceptor of the present invention may be a dip coating method, a spray coating method, a circular amount regulating type coating method, and the like. However, in order to minimize the dissolution of the lower layer surface during coating of the surface layer side of the photosensitive layer, as well as to achieve uniform coating, the spray coating method or the circular amount control type coating method (being a circular slide hopper type as its representative example) is preferably employed. Further, the above-mentioned spray coating is, for example, described in Japanese Patent Publication Open to Public Inspection Nos. 3-90250 and 3-269238, while the above-mentioned circular amount control type coating is described in, for example, Japanese Patent Publication Open to Public Inspection No. 58-189061.

In the present invention, an interlayer, functioning as a barrier, may be provided between the electrically conductive support and the photosensitive layer.

Listed as an interlayer are materials for the interlayer such as casein, polyvinyl alcohols, nitrocellulose, ethylene-acrylic acid copolymers, polyvinyl butyral, phenol resins, polyamides (nylon 6, nylon 66, nylon 610, copolymerized nylon, alkoxymethylated nylon, and the like), polyurethane, gelatin and aluminum oxide, or hardening type interlayers employing metal alkoxides, organic metal complexes, silane coupling agents as described in Japanese Patent Publication Open to Public Inspection No. 9-68870. The thickness of the interlayer is preferably between 0.1 and 10 $\mu$m, and is most preferably between 0.1 and 5 $\mu$m.

In addition, the shape of the support may be a drum, sheet or belt, and is preferably optimum for the electrophotographic apparatus to which the support is applied.

The electrophotographic photoreceptor of the present invention may generally be applied to electrophotographic apparatuses such as copiers, laser printers, LED printers, liquid crystal shutter printers, and the like. In addition, it may widely be applied to apparatuses for display, recording, offset printing, plate making, facsimile, to which electrophotographic techniques are applied.

FIG. 1 shows a cross-sectional view of an image forming apparatus comprising the electrophotographic photoreceptor of the present invention.

In FIG. 1, reference numeral 10 is a photoreceptor drum (a photosensitive body) which is an image holding body. The photoreceptor is prepared by applying the resin layer of the present invention onto an organic photosensitive layer which has been applied onto the drum, which is grounded and is mechanically rotated clockwise. Reference numeral 12 is a scorotron charging unit, and the circumferential surface of the photoreceptor drum 10 is uniformly charged through corona discharge. Prior to charging with the use of this charging unit 12, the charge on the circumferential surface of the photoreceptor may be removed by exposure from exposure section 11 employing light-emitting diodes in order to eliminate the hysteresis of the photoreceptor due to the most recent image formation.

After the photoreceptor is uniformly charged, image exposure is carried out based on image signals employing image exposure unit 13. The image exposure unit 13 in FIG. 1 employs a laser diode (not shown) as the exposure light source. Scanning on the photoreceptor drum is carried out by light of which optical path is bent by reflection mirror 132 after the light has passed through rotating polygonal mirror 131, fθ lens, and the like, and an electrostatic image is formed.

The resulting electrostatic latent image is subsequently developed by development units 14. Around the photoreceptor drum 10, development units 14 are provided, each of which comprises a developer material comprised of a toner such as yellow (Y), magenta (M), cyan (C), black (K), or the like, together with a carrier. First, the first color development is carried out employing development sleeve which has a built-in magnet and rotates along with the developer material. The developer material consists of a carrier prepared by coating an insulating resin around a ferrite particle as a core, and a toner prepared by adding a corresponding colored pigment, a charge control agent, silica, titanium oxide, and the like, to polyester as a major material. The developer material is regulated by a layer forming means (not shown in the figure) so as to form a layer having a thickness of 100 to 600 $\mu$m on the development sleeve, and conveyed to a development zone to achieve development. At the time, development is generally carried out by applying direct current and/or alternative current bias voltage to the gap between the photoreceptor drum 10 and the development sleeve 141.

In the case of color image formation, after visualizing the first color image, the second color image formation is started. Uniform charging is again carried out employing the scorotron charging unit 12, and the second color latent image is formed by the image exposure unit 13. The third and fourth color images are formed by the same image forming processes as those for the second color image, and four color images are visualized on the circumferential surface of the photoreceptor drum 10.

On the other hand, in a monochromatic electrophotographic apparatus, the development unit 14 comprises only black toner and single development forms an image.

After forming an image, recording sheet P is supplied to a transfer zone employing the rotation of paper feeding roller 17 when transfer timing is adjusted.

In the transfer zone, transfer roller (in the transfer unit) 18 is brought into pressure contact with the circumferential surface of the photoreceptor drum 10 in synchronized transfer timing, and multicolor images are simultaneously transferred onto the recording sheet which is appropriately placed.

Subsequently, the recording sheet is subjected to charge elimination employing separation brush (in the separation unit) 19 which is brought into pressure contact at almost the same time when the transfer roller is brought into pressure contact, is separated from the circumferential surface of the photoreceptor drum 10, is conveyed to a fixing unit 20, is subjected to melt adhesion of the toner which is heated and pressed by heating roller 201 and pressure roller 202, and is then ejected to the exterior of the apparatus via paper ejecting roller 21. Incidentally, the above-mentioned transfer roller 18 and the separation brush 19, after passing the recording sheet P, withdraw from the circumferential surface of the photoreceptor drum 10 and are prepared for the subsequent formation of a new toner image.

On the other hand, the photoreceptor drum 10, from which the recording sheet P has been separated, is subjected to removal and cleaning of the residual toner through pressure contact of the blade 221 of cleaning unit 22, is again subjected to charge elimination employing the exposure section 11, subjected to recharging employing the charging unit 12, and subjected to a subsequent image forming process. Further, when color images are formed upon being superimposed on the photoreceptor, the above-mentioned blade 221 is immediately withdrawn after cleaning the photoreceptor surface of the photoreceptor drum.

Further, reference numeral 30 is a detachable cartridge in which a photoreceptor, a transfer unit, a separation unit, and a cleaning unit are integrated.

The present electrophotographic image forming apparatus is constituted in such a manner that components such as the above-mentioned photoreceptor, development unit, cleaning unit the like are integrated as a cartridge, and this unit may be detachable from the main body. Further, the process cartridge may be formed as a single detachable unit in such a manner that at least one of a charging unit, an image exposure unit, a development unit, a transfer or separation unit, and a cleaning unit is integrated with a photoreceptor, and it may be arranged to be detachable employing an guiding means such as a rail in the apparatus main body.

When an image forming apparatus is employed as a copier or a printer, image exposure is carried out in such a manner that light reflected from an original document or a light transmitted through it is irradiated onto a photoreceptor, or an original document is read employing a sensor, said read information is converted into signals, and a laser beam scanning corresponding to the resulting signals, driving a LED array, and driving a liquid crystal shutter array are carried out and light is irradiated onto the photoreceptor.

Further, when employed as the printer of a facsimile machine, the image exposure unit 13 is employed so as to carry out exposure to print received data.

EXAMPLES

The present invention will be detailed below with reference to examples.

A photoreceptor was prepared as described below.

| <Interlayer> | |
|---|---|
| Polyamide resin (Amiran CM-8000, manufactured by Toray Co.) | 60 g |
| Methanol | 1600 ml |
| 1-Butanol | 400 ml |

were mixed and dissolved to prepare an interlayer coating composition. The resulting coating composition was applied onto a cylindrical aluminum base body employing a dip coating method to form a 0.3 $\mu$m thick interlayer.

| <Charge Generating Layer> | |
|---|---|
| Titanyl phthalocyanine | 60 g |
| Silicone resin solution (KR5240, 15% xylene-butanol solution, manufactured by Shin-Etsu Kagaku Co.) | 700 g |
| 2-Butanone | 2000 ml |

were mixed and dispersed for 10 hours employing a sand mill to prepare a charge generating layer coating composition. The resultant coating composition was applied onto the aforementioned interlayer employing a dip coating method to form a 0.2 $\mu$m thick charge generating layer.

The measurement results of the X-ray diffraction spectra of titanyl phthalocyanine showed peaks of Bragg angle 2θ at 7.4°, 9.6°, 14.9°, 18.0°, 24.1°, and 27.2°, with a maximum peak at 27.2°.

| <Charge Transport Layer> | |
|---|---|
| Charge transport material (D1) | 200 g |
| Bisphenol Z type polycarbonate (IUPILON Z300, manufactured by Mitsubishi Gas Kagaku Co.) | 300 g |
| 1,2-Dichloroethane | 2000 ml |

were mixed and dissolved to prepare a charge transport layer coating composition. The resultant coating composition was applied onto the aforementioned charge generating layer employing a dip coating method, to form a 20 $\mu$m thick charge transport layer.

Titanyl phthalocyanine

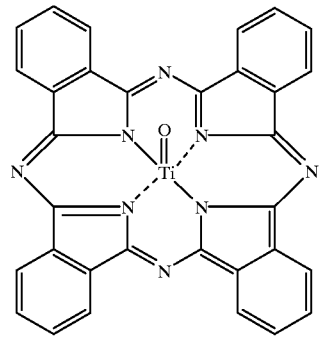

D1

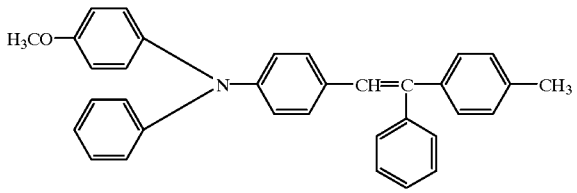

In addition, molecular sieve 4A was added to 10 weight parts of a polysiloxane resin comprised of 80 mole percent of methylsiloxane units and 20 mole percent of methylphenylsiloxane units, and the resulting mixture was kept standing for 15 hours and then subjected to dehydration treatment. Said resin was then dissolved in 10 weight parts of toluene. After that, 5 weight parts of methyltrimethoxysilane and 0.2 weight part of dibutyl tin acetate were added to the resulting solution to obtain a uniform solution.

Added and mixed to the resultant solution were 6 weight parts of dihydroxymethyltriphenylamine (Exemplified Compound T-1). Said solution was coated as a protective layer having a dried layer thickness of 1 μm, and was cured at 120° C. for one hour to prepare the photoreceptor of Example 1.

Example 2

A photoreceptor was prepared in the same manner as Example 1, except that dihydroxymethyltriphenylamine in the protective layer was replaced with 4-[2-(triethoxysilyl) ethyl]triphenylamine.

Example 3

An interlayer and a charge generating layer were prepared and coated in the same manner as Example 1. Onto the resultant coating was applied a solution prepared as described below so as to obtain a dried layer thickness of 1 μm of a protective layer, and was dried at 110° C. for one hour to prepare a photoreceptor. Added and dissolved to 60 weight parts of commercially available KP-854 (manufactured by Shin-Etsu Kagaku Kogyo Co.) comprised of an organic silicon compound was 60 weight parts of 2-propanol, and in the same manner as Example 1, 6 weight parts of dihydroxytriphenylamine (Exemplified Compound T-1) was added to the resulting mixture and mixed while stirring to prepare the aforementioned coating solution.

Example 4

An interlayer, a charge generating layer, and a charge transport layer were prepared and coated in the same manner as Example 1. Onto the resultant coating was applied a solution prepared as described below so as to obtain a dried layer thickness of 1 μm of a protective layer, and was dried at 110° C. for one hour to prepare a photoreceptor. Added and dissolved to 60 weight parts of commercially available x-4-2269 (manufactured by Shin-Etsu Kagaku Kogyo Co.) comprised of an organic silicon compound were 60 weight parts of 2-propanol, and in the same manner as Example 1, 6 weight parts of dihydroxytriphenylamine (Exemplified Compound T-1) were added to the resulting mixture and mixed while stirring to prepare the aforementioned coating solution.

Example 5

A photoreceptor was prepared in the same manner as Example 1, except that titanyl phthalocyanine employed in Example 1 was replaced with one having peaks at 9.0°, 14.2°, 23.9°, and 27.2° of Bragg angle 2θ, with a maximum peak at 27.2°.

Example 6

A photoreceptor was prepared in the same manner as Example 1, except that titanyl phthalocyanine employed in Example 1 was replaced with one having peaks at 9.3°, 10.6°, 13.2°, 15.1°, 20.8°, and 26.2° of Bragg angle 2θ, with a maximum peak at 26.2°.

Example 7

A photoreceptor was prepared in the same manner as Example 1, except that titanyl phthalocyanine employed in Example 1 was replaced with one having peaks at 7.5°, 10.3°, 22.6°, 24.5°, 25.4°, and 28.6° of Bragg angle 2θ, with a maximum peak at 7.5°.

Example 8

A photoreceptor was prepared in the same manner as Example 1, except that titanyl phthalocyanine employed in Example 1 was replaced with one having peaks at 7.0°, 15.6°, and 25.5° of Bragg angle 2θ, with a maximum peak at 7.0°.

Example 9

A photoreceptor was prepared in the same manner as Example 1, except that 0.3 weight part of hindered amine compound (2-1) was added to the protective surface layer coating composition employed in Example 1.

Example 10

A photoreceptor was prepared in the same manner as Example 1, except that 0.3 weight part of hindered amine compound (1-1) was added to the protective surface layer coating composition employed in Example 1.

Example 11

A photoreceptor was prepared in the same manner as Example 5, except that 0.3 weight part of hindered amine compound (2-1) was added to the protective surface layer coating composition employed in Example 5.

Example 12

A photoreceptor was prepared in the same manner as Example 6, except that 0.3 weight part of hindered amine compound (2-1) was added to the protective surface layer coating composition employed in Example 6.

Example 13

A photoreceptor was prepared in the same manner as Example 1, except that 0.3 weight part of hindered amine compound (2-1) was added to the protective surface layer coating composition employed in Example 7.

Example 14

A photoreceptor was prepared in the same manner as Example 8, except that 0.3 weight part of hindered amine compound (2-1) was added to the protective surface layer coating composition employed in Example 8.

Comparative Example 1

A photoreceptor was prepared in the same manner as Example 1, except that after forming a 20 μm thick charge transport layer on the charge generating layer in Example 1, the coating was dried at 120° C. for one hour.

Comparative Example 2

A photoreceptor was prepared in the same manner as Example 1, except that titanyl phthalocyanine employed in Example 1 was replaced with an amorphous one (having a non-crystal structure) exhibiting no clear peak in the X-ray diffraction spectra.

<Evaluations>

Evaluations were carried out as follows: a copier for evaluation was prepared by modifying a Digital Copier Konica 7050, manufactured by Konica Corp., in which exposure amount was optimized so as to obtain an electric potential (VL) of −80 V during initial exposure. Then each photoreceptor of the aforementioned Examples 1 through 14, and Comparative Examples 1 and 2 was installed in turn in said copier and after setting the initial charge potential at −650 V, 50,000 copies were run for practical imaging evaluations.

After a run of said 50,000 copies, variation in electric potential of the unexposed part as well as the decrease in the layer thickness was measured for each photoreceptor. Further, regarding the evaluation of interference fringes on images, the formation of interference fringes on images having intermediate density was visually evaluated.

Evaluation criteria were as follows:

A: good

B: acceptable for practical use

C: unacceptable for practical use

D: totally unacceptable

Table 1 shows the results.

TABLE 1

| | Variation in Electric Potential | | Decrease in Layer Thickness | Image Evaluation of Interference |
|---|---|---|---|---|
| | ΔVH | ΔVL | (in μm) | Fringes |
| Example 1 | 28 | 25 | 0.17 | A |
| Example 2 | 45 | 68 | 0.32 | B |
| Example 3 | 33 | 31 | 0.2 | A |
| Example 4 | 20 | 28 | 0.12 | A |
| Example 5 | 54 | 63 | 0.14 | B |
| Example 6 | 29 | 40 | 0.19 | A |
| Example 7 | 44 | 33 | 0.14 | A |
| Example 8 | 49 | 64 | 0.19 | A |
| Example 9 | 9 | 20 | 0.15 | A |
| Example 10 | 17 | 15 | 0.16 | A |
| Example 11 | 36 | 45 | 0.17 | B |
| Example 12 | 14 | 28 | 0.15 | A |
| Example 13 | 34 | 27 | 0.17 | A |
| Example 14 | 41 | 40 | 0.16 | A |
| Example 15 | 62 | 115 | 0.44 | B |
| Comparative Example 1 | 34 | 28 | 2.74 | D |
| Comparative Example 2 | 57 | 149 | 0.26 | C |
| Comparative Example 3 | 36 | 227 | 0.2 | C |

Example 21

<Interlayer>

Polyamide resin (X-1874M, manufactured by Daiseru Hules Co.) 60 g

Methanol 1600 ml

1-Butanol 400 ml were mixed and dissolved to prepare an interlayer coating composition. The resulting coating composition was applied onto a cylindrical aluminum base body employing a dip coating method, to form a 0.3 μm thick interlayer.

| <Charge Generating Layer> | |
|---|---|
| Perylene (A) | 60 g |
| Butyral resin (BL-S, manufactured by Sekisui Kagaku Co.) | 700 g |
| 2-Butanone | 2000 ml |

were mixed and dispersed for 30 hours employing a sand mill, to prepare a charge generating layer coating composition. The resultant coating composition was applied onto the aforementioned interlayer employing a dip coating method, to form a 0.2 μm thick charge generating layer.

| <Charge Transport Layer> | |
|---|---|
| Charge transport material (D1) | 200 g |
| Bisphenol Z type polycarbonate (IUPILON Z300, manufactured by Mitsubishi Gas Kagaku Co.) | 300 g |
| 1,2-Dichloroethane | 2000 ml |

were mixed and dissolved to prepare a charge transport layer coating composition. The resultant coating composition was applied onto the aforementioned charge generating layer employing a dip coating method to form a 20 μm thick charge transport layer.

Mixture of (A)

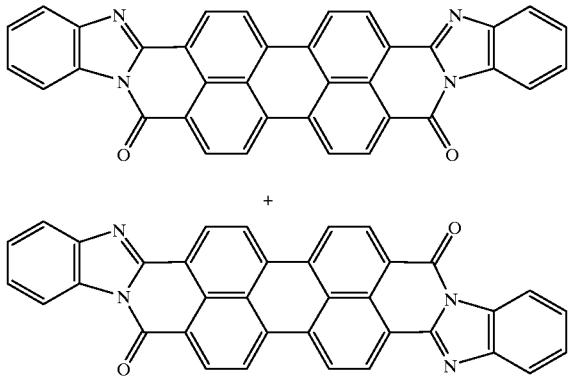

(B)

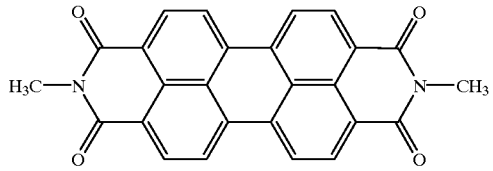

(C)

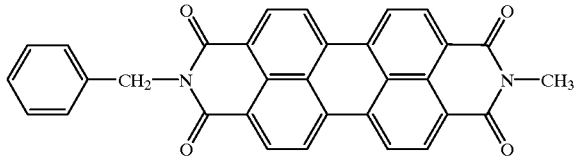

(D)

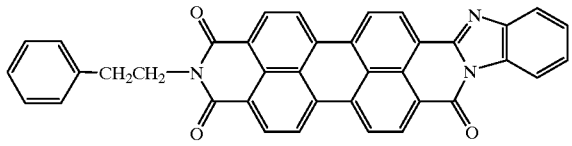

-continued

D1

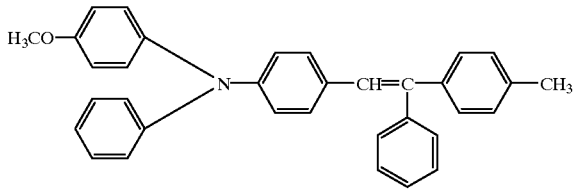

<Protective Surface Layer>

In addition, molecular sieve 4A was added to 10 weight parts of a polysiloxane resin comprised of 80 mole percent of methylsiloxane units and 20 mole percent of methylphenylsiloxane units, and the resulting mixture was kept standing for 15 hours and then subjected to dehydration treatment. Said resin was dissolved in 10 weight parts of toluene. After that, 5 weight parts of methyltrimethoxysilane and 0.2 weight part of dibutyl tin acetate were added to the resulting solution to obtain a uniform solution.

Added and mixed to the resultant solution were 12 weight parts of dihydroxymethyltriphenylamine (Exemplified Compound T-1). To prepare the photoreceptor of Example 21, said solution was coated as a protective layer having a dried layer thickness of 1 μm, and was cured at 120° C. for one hour.

Example 22

A photoreceptor was prepared in the same manner as Example 1, except that dihydroxymethyltriphenylamine in the protective layer was replaced with 4-[2-(triethoxysilyl) ethyl]triphenylamine.

Examples 23 through 25

Photoreceptors were prepared in the same manner as Example 21, except that the perylene pigment in Example 21 was replaced with each of perylene pigments of compounds (B) through (D).

Example 26

An interlayer, and a charge generating layer were prepared and coated in the same manner as Example 21. Onto the resultant coating was applied a solution prepared as described below so as to obtain a dried layer thickness of 1 μm of a protective layer, and was dried at 110° C. for one hour to prepare a photoreceptor. Added and dissolved to 60 weight parts of commercially available KP-854 (manufactured by Shin-Etsu Kagaku Kogyo Co.) comprised of an organic silicon compound were 60 weight parts of 2-propanol, and in the same manner as Example 1, 6 weight parts of dihydroxytriphenylamine (Exemplified Compound T-1) were added to the resulting mixture and mixed while stirring to prepare the aforementioned coating solution.

Example 27

An interlayer, a charge generating layer, and a charge transport layer were prepared and coated in the same manner as Example 21. Onto the resultant coating was applied a solution prepared as described below so as to obtain a dried layer thickness of 1 μm of a protective layer, and was dried at 110° C. for one hour to prepare a photoreceptor. Added and dissolved to 60 weight parts of commercially available x-4-2269 (manufactured by Shin-Etsu Kagaku Kogyo Co.) comprised of an organic silicon compound were 60 weight parts of 2-propanol, and in the same manner as Example 1, 6 weight parts of dihydroxytriphenylamine (Exemplified Compound T-1) were added to the resulting mixture and mixed while stirring to prepare the aforementioned coating solution.

Example 28

A photoreceptor was prepared in the same manner as Example 21, except that hindered amine compound (2-1), in the protective surface layer coating composition employed in Example 21, was replaced with hindered phenol (1-32).

Example 29

A photoreceptor was prepared in the same manner as Example 21, except that the hindered amine compound in the protective surface layer in Example 21 was not employed.

Comparative Example 21

A photoreceptor was prepared in the same manner as Example 21, except that after forming a 20 μm thick charge transport layer on the charge generating layer in Example 21, drying was carried out at 120° C. for one hour.

Example 22

A photoreceptor was prepared in the same manner as Example 21, except that the charge generating material in Example 21 was replaced with X type metal-free phthalocyanine.

Example 23

A photoreceptor was prepared in the same manner as Example 21, except that the charge generating material in Example 21 was replaced with an azo pigment represented by the formula (E) represented by the structure shown below.

(E)

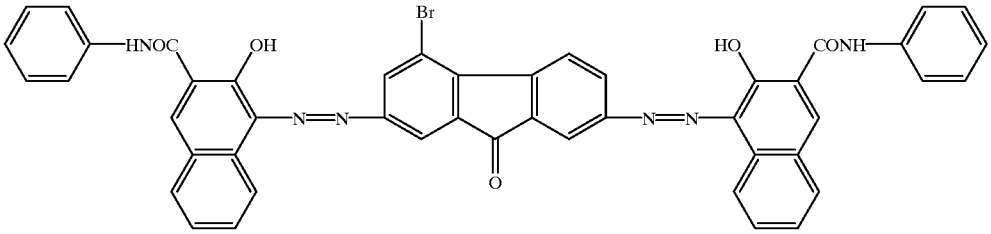

<Evaluations>

Evaluations were carried out as follows: a copier for evaluation copier was prepared by modifying a Digital Copier, Konica 7050 manufactured by Konica Corp., in which a semiconductor laser with an exposure light source having a wavelength of 680 nm was installed and the exposure amount was optimized so as to obtain an electric potential of −650 V during initial exposure. Then each of the aforementioned photoreceptors was installed in said copier and 50,000 copies were run for practical imaging evaluations.

Table 2 shows the results.

TABLE 2

| | Compound | Variation in Electric Potential ΔVH (V) | ΔVL (V) | Decrease in Layer Thickness (in μm) | Image Evaluation |
|---|---|---|---|---|---|
| Example 21 | A | 28 | 25 | 0.17 | good |
| Example 22 | A | 45 | 68 | 0.42 | formation of slight black streaks |
| Example 23 | B | 61 | 51 | 0.20 | good |
| Example 24 | C | 20 | 28 | 0.16 | good |
| Example 25 | D | 34 | 33 | 0.19 | good |
| Example 26 | A | 39 | 34 | 0.23 | good |
| Example 27 | A | 29 | 44 | 0.19 | good |
| Example 28 | A | 43 | 48 | 0.24 | good |
| Example 29 | A | 50 | 52 | 0.33 | formation of slight staining |
| Comparative Example 21 | A | 54 | 104 | 3.74 | decrease in density |
| Comparative Example 22 | phthalocyanine | 87 | 103 | 0.24 | decrease in density |
| Comparative Example 23 | azo | 127 | 179 | 0.26 | staining formation and decrease in density |

It was found that Examples 1 through 7 of the present invention exhibited excellent properties, while Comparative Examples 1, 2, and 3, which were not in the scope of the present invention, suffered problems in at least one item of properties.

Example 30

Evaluations were carried out as follows: a copier for evaluation was prepared by modifying a Digital Copier Konica 7050 manufactured by Konica Corp., in which a semiconductor laser with an exposure light source having a wavelength of 680 nm was installed. Then each of the aforementioned photoreceptors in turn was installed in said copier and the initial charge potential was set at −650 V. After a run of 50,000 copies, the copier was temporarily shut down for 3 days. Then, a surface electrometer was installed in the development section of the photoreceptor and the electric potential of unexposed parts was measured after the first rotation as well as the second rotation. Further, staining of the white part after the first rotation was evaluated in terms of relative density. Table 2 shows the measurement results.

Comparative Example 24

Measurements were carried out in the same manner as Example 30, except that in Example 30, the photoreceptor in Example 21 was replaced with one in Comparative Example 23. Table 3 shows the measurement results.

TABLE 3

| | After First Rotation | After Second Rotation | Stain Density |
|---|---|---|---|
| Example 30 | −641 | −648 | 0.002 |
| Comparative Example 24 | −594 | −649 | 0.05 |

It was found that Example 30 of the present invention exhibited excellent results in all items of properties, but Comparative Example 24, which was not in the scope of the present invention, suffered problems with some items of properties.

As can clearly be seen from Table 1, in the combinations in Examples of the present invention, the stability of the electric potential, as well as the image evaluation of interference fringes exhibited excellent properties. However, it was found that in Comparative Examples, which were not in the scope of the present invention, one of or both of these properties were poor, and the image evaluation of interference fringes resulted in problems.

Further, as shown in Examples 1, 3, 4, 6, 7, 8, 9, 10, 12, 13, and 14, it was found that more preferable results were obtained by the selection of titanyl phthalocyanines having specific crystal structures, as well as by using charge transport materials bonded to organic silicon compounds.

According to the present invention, it is possible to obtain an electrophotographic photoreceptor which exhibits excellent surface strength properties as well as excellent stability of electric potential and minimizes the effects of interference fringes due to laser beam exposure, and an image forming apparatus and a process cartridge using the same.

What is claimed is:

1. An electrophotographic photoreceptor comprising an electrically conductive support, a photosensitive layer provided on the support, wherein the photosensitive layer comprises a charge generating layer containing titanyl phthalocyanine having crystal structure and a charge transport layer having charge transportability thereon, and a protective surface layer provided on the photosensitive layer, wherein the protective surface layer contains structural units having charge transportability and a siloxane resin having a cross linking structure.

2. The electrophotographic photoreceptor of claim 1 wherein the titanyl phthalocyanine having a maximum peak of Bragg angle (2θ±0.2°) at 27.2° with respect to Cu-Kα ray.

3. The electrophotographic photoreceptor of claim 2 wherein the titanyl phthalocyanine further has a maximum peak of Bragg angle (2θ±0.2°) at 9.6° with respect to Cu-Kα ray.

4. The electrophotographic photoreceptor of claim 1 wherein the protective surface layer of said electrophotographic photoreceptor is comprised of a siloxane resin having a cross linking structure obtained by allowing an organic silicon compound having a hydroxyl group or a hydrolyzable group to react with a compound comprising structural units having a hydroxyl group as well as charge transportability.

5. The electrophotographic photoreceptor of claim 1 wherein the titanyl phthalocyanine having a maximum peak of Bragg angle (2θ±0.2°) at 26.2° with respect to Cu-Kα ray.

6. The electrophotographic photoreceptor of claim 5 wherein the protective surface layer of said electrophotographic photoreceptor is comprised of a siloxane resin having a cross linking structure obtained by allowing an organic silicon compound having a hydroxyl group or a hydrolyzable group to react with a compound comprising structural units having a hydroxyl group as well as charge transportability.

7. The electrophotographic photoreceptor of claim 1 wherein the titanyl phthalocyanine having a maximum peak of Bragg angle (2θ±0.2°) at 7.5° with respect to Cu-Kα ray.

8. The electrophotographic photoreceptor of claim 7 wherein the protective surface layer of said electrophotographic photoreceptor is comprised of a siloxane resin having a cross linking structure obtained by allowing an organic silicon compound having a hydroxyl group or a hydrolyzable group to react with a compound comprising structural units having a hydroxyl group as well as charge transportability.

9. The electrophotographic photoreceptor of claim 1 wherein the titanyl phthalocyanine having a maximum peak of Bragg angle (2θ±0.2°) at 7.0° with respect to Cu-Kα ray.

10. The electrophotographic photoreceptor of claim 9 wherein the protective surface layer of said electrophotographic photoreceptor is comprised of a siloxane resin having a cross linking structure obtained by allowing an organic silicon compound having a hydroxyl group or a hydrolyzable group to react with a compound comprising structural units having a hydroxyl group as well as charge transportability.

11. The electrophotographic photoreceptor of claim 1 wherein said protective surface layer comprises an antioxidant.

12. The electrophotographic photoreceptor of claim 1 wherein said antioxidant is either hindered amine compound or hindered phenol compound.

13. An image forming apparatus employing an electrophotographic photoreceptor of claim 1 wherein image formation is carried out through processes consisting of charging, image exposure, development, transfer, separation, and cleaning.

14. A process cartridge employed for image formation through processes consisting of charging, image exposure, development, transfer, separating, and cleaning, wherein the process cartridge composed of an electrophotographic photoreceptor of claim 1 in combination with at least one of a charging unit, an image exposing unit, a development unit, a transfer or separation unit and a cleaning unit.

15. An electrophotographic photoreceptor comprising an electrically conductive support, a photosensitive layer provided on the support, wherein the photosensitive layer comprises a charge generating layer containing perylene having crystal structure and a charge transport layer having charge transportability thereon, and a protective surface layer provided on the photosensitive layer, wherein the protective surface layer contains structural units having charge transportability and a siloxane resin having a cross linking structure.

16. The electrophotographic photoreceptor of claim 15 wherein the perylene compound is represented by the formula of (1), (2) or (3).

(1)

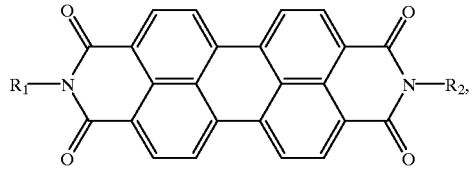

(2)

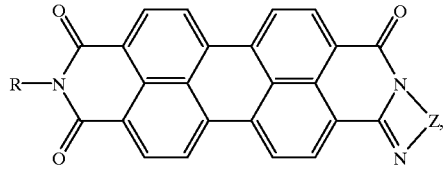

(3)

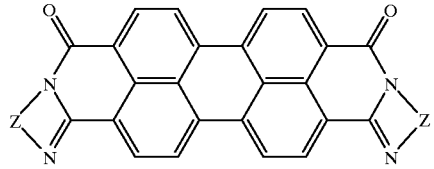

or

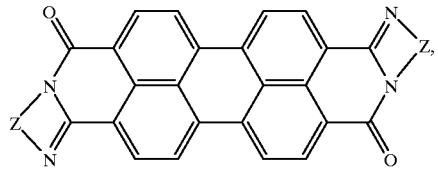

wherein $R_1$ and $R_2$ are the same or different, and each independently represents a hydrogen atom, alkyl, cycloalkyl, aryl, alkoxy, alkylamino, dialkylamino, benzyl, phenetyl, or heterocyclic group which may be substituted or unsubstituted, or 1,4-phenylene group, Z is atomic group necessary to form a substituted or unsubstituted heterocyclic group.

17. The electrophotographic photoreceptor of claim 15 wherein the protective surface layer of said electrophotographic photoreceptor is comprised of a siloxane resin having a cross linking structure obtained by allowing an organic silicon compound having a hydroxyl group or a hydrolyzable group to react with a compound comprising structural units having a hydroxyl group as well as charge transportability.

18. The electrophotographic photoreceptor of claim 15 wherein said protective surface layer comprises an antioxidant.

19. The electrophotographic photoreceptor of claim 18 wherein said antioxidant is either hindered amine compound or hindered phenol compound.

20. An image forming apparatus employing an electrophotographic photoreceptor of claim 15 wherein image formation is carried out through processes consisting of charging, image exposure, development, transfer, separation, and cleaning.

21. A process cartridge employed for image formation through processes consisting of charging, image exposure, development, transfer, separating, and cleaning, wherein the process cartridge composed of an electrophotographic photoreceptor of claim 15 in combination with at least one of a charging unit, an image exposing unit, a development unit, a transfer or separation unit and a cleaning unit.

* * * * *